US010149999B2

(12) United States Patent
Moschel

(10) Patent No.: US 10,149,999 B2
(45) Date of Patent: Dec. 11, 2018

(54) LOWER BODY EXERCISE EQUIPMENT WITH UPPER BODY PEDALS AND METHODS OF USING THE SAME

(71) Applicant: Michael Moschel, Astoria, NY (US)

(72) Inventor: Michael Moschel, Astoria, NY (US)

( * ) Notice: Subject to any disclaimer, the term of this patent is extended or adjusted under 35 U.S.C. 154(b) by 612 days.

(21) Appl. No.: 14/154,957

(22) Filed: Jan. 14, 2014

(65) Prior Publication Data

US 2014/0364284 A1 Dec. 11, 2014

Related U.S. Application Data

(63) Continuation-in-part of application No. 14/104,664, filed on Dec. 12, 2013, and a continuation-in-part of application No. 13/967,945, filed on Aug. 15, 2013.
(Continued)

(51) Int. Cl.
*A63B 23/035* (2006.01)
*A63B 22/20* (2006.01)
(Continued)

(52) U.S. Cl.
CPC .... *A63B 22/0605* (2013.01); *A63B 21/00047* (2013.01); *A63B 21/062* (2013.01); *A63B 21/0628* (2015.10); *A63B 21/4031* (2015.10); *A63B 21/4047* (2015.10); *A63B 21/4049* (2015.10); *A63B 22/0002* (2013.01); *A63B 22/0012* (2013.01); *A63B 23/0216* (2013.01);
(Continued)

(58) Field of Classification Search
CPC ..... A63B 21/062; A63B 21/1461; A63B 21/1496; A63B 21/1488; A63B 22/001; A63B 22/0012; A63B 22/0605; A63B 23/03583; A63B 23/03591; A63B 23/03516; A63B 23/03525; A63B 23/03558; A63B 23/03566; A63B 23/03575; A63B 2208/0252; A63B 2023/0411
USPC ..... 482/62, 93–103
See application file for complete search history.

(56) References Cited

U.S. PATENT DOCUMENTS 3,833,216 A 9/1974 Philbin
4,333,644 A * 6/1982 Lambert, Jr. ..... A63B 21/06 482/101
(Continued)

FOREIGN PATENT DOCUMENTS

| | | |
|---|---|---|
| CA | 2630430 | 11/2009 |
| KR | 1020120070239 | 6/2012 |
| WO | 9700031 | 1/1997 |

OTHER PUBLICATIONS

U.S. Appl. No. 61/831,903, filed Jun. 6, 2013.
(Continued)

*Primary Examiner* — Nyca T Nguyen

(57) ABSTRACT

A physical exercise apparatus includes a frame, a seat, an arm, and a pair of cycling hand pedals. The seat is supported by the frame and is configured to support a user in an at least partially supine position. The arm is movably attached to a first portion of the frame and coupled with a linearly movable resistance load. The pair of cycling hand pedals is attached to a second portion of the frame and is independently movable from the arm so that the user can cycle the pair of cycling hand pedals while separately moving the arm with a portion of his or her lower body.

6 Claims, 21 Drawing Sheets

Related U.S. Application Data

(60) Provisional application No. 61/872,207, filed on Aug. 30, 2013, provisional application No. 61/831,903, filed on Jun. 6, 2013.

(51) Int. Cl.

| | |
|---|---|
| ***A63B 22/06*** | (2006.01) |
| ***A63B 21/00*** | (2006.01) |
| ***A63B 21/062*** | (2006.01) |
| ***A63B 22/00*** | (2006.01) |
| ***A63B 23/02*** | (2006.01) |
| ***A63B 23/14*** | (2006.01) |
| *A63B 23/12* | (2006.01) |

(52) U.S. Cl.

CPC .. *A63B 23/03516* (2013.01); *A63B 23/03525* (2013.01); *A63B 23/03533* (2013.01); *A63B 23/14* (2013.01); *A63B 21/4035* (2015.10); *A63B 23/1254* (2013.01); *A63B 2022/0652* (2013.01); *A63B 2208/0204* (2013.01); *A63B 2208/0233* (2013.01); *A63B 2208/0238* (2013.01); *A63B 2208/0247* (2013.01); *A63B 2208/0252* (2013.01)

(56) References Cited

U.S. PATENT DOCUMENTS

| | | | | |
|---|---|---|---|---|
| 4,625,962 | A | 12/1986 | Street | |
| 4,830,362 | A | 5/1989 | Bull | |
| 4,838,547 | A | 6/1989 | Sterling | |
| 4,842,269 | A | 6/1989 | Huang | |
| 4,974,840 | A | 12/1990 | Welch | |
| 5,145,479 | A | 9/1992 | Olschansky et al. | |
| 5,178,593 | A * | 1/1993 | Roberts | A63B 23/03516 482/56 |
| 5,318,487 | A | 6/1994 | Golen et al. | |
| 5,405,305 | A | 4/1995 | Wilkinson et al. | |
| 5,496,236 | A | 3/1996 | Buonauito | |
| 5,580,341 | A | 12/1996 | Simonson | |
| 5,823,921 | A | 10/1998 | Dawson | |
| 5,941,803 | A * | 8/1999 | Chamberlain | A63B 21/0552 482/51 |
| 5,976,062 | A * | 11/1999 | Toups | A63B 21/062 482/100 |
| 6,071,216 | A | 6/2000 | Giannelli et al. | |
| 6,090,021 | A | 7/2000 | Flowers et al. | |
| 6,413,192 | B2 | 7/2002 | Abelbeck | |
| 6,547,702 | B1 * | 4/2003 | Heidecke | A63B 21/0053 482/57 |
| 6,551,219 | B1 * | 4/2003 | Brown | A63B 22/0605 482/142 |
| 6,902,515 | B2 | 6/2005 | Howell et al. | |
| 7,322,907 | B2 | 1/2008 | Bowser | |
| 7,513,853 | B1 | 4/2009 | Russ | |
| 7,524,272 | B2 | 4/2009 | Bruck et al. | |
| 7,695,411 | B2 | 4/2010 | Pandozy | |
| 7,740,563 | B2 | 6/2010 | Dalebout et al. | |
| 7,775,936 | B2 | 8/2010 | Wilkinson | |
| 7,874,971 | B2 * | 1/2011 | Reyes | A63B 21/1411 482/130 |
| 7,985,167 | B2 | 7/2011 | Nizam | |
| 8,206,272 | B2 | 6/2012 | Greene | |
| 8,388,504 | B2 | 3/2013 | Ellis | |
| 8,821,354 | B1 | 9/2014 | Tabahi | |
| 2002/0035017 | A1 | 3/2002 | Pertegaz-Esteban | |
| 2004/0192522 | A1 | 9/2004 | Hippensteel | |
| 2005/0101463 | A1 | 5/2005 | Chen | |
| 2005/0277524 | A1 | 12/2005 | Bae | |
| 2006/0019804 | A1 | 1/2006 | Young | |
| 2007/0173384 | A1 * | 7/2007 | Sechrest | A63B 21/154 482/99 |
| 2008/0051274 | A1 | 2/2008 | Greene | |
| 2008/0318738 | A1 | 12/2008 | Chen | |
| 2010/0035729 | A1 | 2/2010 | Pandozy | |
| 2010/0210425 | A1 | 8/2010 | Bowser | |
| 2011/0172064 | A1 | 7/2011 | Cutler et al. | |
| 2011/0245043 | A1 | 10/2011 | Mitchell | |
| 2014/0364281 | A1 | 12/2014 | Moschel | |
| 2014/0364282 | A1 | 12/2014 | Moschel | |
| 2014/0364283 | A1 | 12/2014 | Moschel | |
| 2014/0364285 | A1 | 12/2014 | Moschel | |

OTHER PUBLICATIONS

U.S. Appl. No. 61/872,207, filed Aug. 30, 2013.

U.S. Appl. No. 13/967,945, filed Aug. 15, 2013.

Photograph of prior art exercise machine accessed on Dec. 5, 2013 from URL. https://encrypted-tbn2.gstatic.com/images?q=tbn: ANd9GcSllvDYh7Y4av62BDNf61YHLvSaxArhi2MxY3KgGMallS1UeuqXbA.

Photograph of prior art exercise machine. Accessed from World Wide Web on Sep. 20, 2013.

U.S. Appl. No. 14/104,664, filed Dec. 12, 2013.

* cited by examiner

LOWER BODY EXERCISE EQUIPMENT WITH UPPER BODY PEDALS AND METHODS OF USING THE SAME

CROSS-REFERENCE TO RELATED APPLICATIONS

This application claims the benefit of and priority to each of U.S. Provisional Patent Application No. 61/831,903, filed on Jun. 6, 2013, U.S. patent application Ser. No. 13/967,945, filed on Aug. 15, 2013, U.S. Provisional Patent Application No. 61/872,207, filed on Aug. 30, 2013, and U.S. patent application Ser. No. 14/104,664, filed on Dec. 12, 2013, the entire contents of each of which are incorporated by reference herein.

FIELD

The present invention generally relates to physical exercise equipment and methods of using the same, and in particular, to physical exercise equipment that includes a lower body exercise and a separate, independent, repetitive upper body exercise. In embodiments, the repetitive upper body exercise may position a user in a manner so that the user can use physical exercise equipment to inhibit, improve, and/or correct muscular imbalances.

SUMMARY

According to an exemplary embodiment, a physical exercise apparatus comprises a frame, a seat, an arm, and a pair of cycling hand pedals. The seat is supported by the frame and configured to support a user in an at least partially supine position. The arm is movably attached to a first portion of the frame and coupled with a linearly movable resistance load. The pair of cycling hand pedals is attached to a second portion of the frame and independently movable from the arm so that the user can cycle the pair of cycling hand pedals while separately moving the arm with a portion of his or her lower body.

In an exemplary embodiment, the arm is movably attached to the first portion of the frame so that the arm may be moved frontally away from the user.

In an exemplary embodiment, the arm is movably attached to the first portion of the frame so that the arm may be moved generally upwardly with respect to the seat.

In an exemplary embodiment, the arm is movably attached to the first portion of the frame so that the arm may be moved rearwardly toward the user.

In an exemplary embodiment, the arm is movably attached to the first portion of the frame so that the arm may be moved generally downwardly with respect to the seat.

In an exemplary embodiment, the arm is positioned in front of the seat.

In an exemplary embodiment, the physical exercise equipment apparatus further comprises a base to support a portion of a user's feet.

In an exemplary embodiment, the physical exercise equipment apparatus further comprises a bracing arm for maintaining a portion of a user's lower body in a substantially stationary position.

According to an exemplary embodiment, a method of physical exercise training comprises: (a) providing a physical exercise apparatus, comprising: a frame; a seat supported by the frame; an arm movably attached to a first portion of the frame and coupled with a linearly movable resistance load; and a pair of cycling hand pedals attached to a second portion of the frame; (b) positioning at least a portion of a body of a user in an at least partially supine position on the seat; (c) accessing by the user the arm from the at least partially supine position; and (d) simultaneously engaging by the user the arm to exercise a portion of an anatomy of the user and independently cycling by the user the pair of cycling hand pedals using a pair of hands of the user while the user is in the at least partially supine position.

In an exemplary embodiment, the step of engaging by the user the arm includes moving the arm frontally away from the user.

In an exemplary embodiment, the step of engaging by the user the arm includes moving the arm generally upwardly with respect to the seat.

In an exemplary embodiment, the step of engaging by the user the arm includes moving the arm rearwardly toward the user.

In an exemplary embodiment, the step of engaging by the user the arm includes moving the arm generally downwardly with respect to the seat.

According to an exemplary embodiment, a physical exercise equipment apparatus comprises a frame, a base, an arm, and a pair of cycling hand pedals. The base is supported by the frame and configured to support a user in a substantially upright position. The arm is movably attached to a first portion of the frame and coupled with a linearly movable resistance load. The pair of cycling hand pedals is attached to a second portion of the frame and independently movable from the arm so that the user can cycle the pair of cycling hand pedals while separately moving the arm with a portion of his or her upper body.

In an exemplary embodiment, the arm is movably attached to the first portion of the frame so that the arm may be moved generally upwardly with respect to the base.

In an exemplary embodiment, the physical exercise apparatus further comprises a pair of extensions extending from the arm.

According to an exemplary embodiment, a method of physical exercise training comprises: (a) providing a physical exercise apparatus, comprising: a frame; a base supported by the frame; an arm movably attached to a first portion of the frame and coupled with a linearly movable resistance load; and a pair of cycling hand pedals attached to a second portion of the frame; (b) positioning at least a portion of a body of a user in an at least partially upright position on the base; (c) accessing by the user the arm from the at least partially upright position; and (d) simultaneously engaging by the user the arm to exercise a portion of an anatomy of the user and independently cycling by the user the pair of cycling hand pedals using a pair of hands of the user while the user is in the at least partially upright position.

In an exemplary embodiment, engaging by the user the arm includes moving the arm generally upwardly with respect to the base.

According to an exemplary embodiment, a physical exercise apparatus comprises a frame, a base, a sled, and a pair of cycling hand pedals. The base is supported by the frame and configured to support a user in an at least partially upright position. The sled is movably attached to a first portion of the frame and coupled with a linearly movable resistance load. The pair of cycling hand pedals is attached to a second portion of the frame and independently movable from the sled so that the user can cycle the pair of cycling hand pedals while separately moving the sled with a portion of his or her upper body.

In an exemplary embodiment, the sled is movably attached to the first portion of the frame so that the sled may be moved generally upwardly with respect to the base.

According to an exemplary embodiment, a method of physical exercise training comprises: (a) providing a physical exercise apparatus, comprising: a frame; a base supported by the frame; a sled movably attached to a first portion of the frame and coupled with a linearly movable resistance load; and a pair of cycling hand pedals attached to a second portion of the frame and independently movable from the sled; (b) positioning at least a portion of a body of a user in an at least partially upright position on the base; (c) accessing by the user the sled from the at least partially upright position; and (d) simultaneously engaging by the user the sled to exercise a portion of an anatomy of the user and independently cycling by the user the pair of cycling hand pedals using a pair of hands of the user while the user is in the at least partially upright position.

In an exemplary embodiment, engaging by the user the sled includes moving the sled generally upwardly with respect to the base.

According to an exemplary embodiment, a physical exercise apparatus comprises a frame, a seat, a sled, and a pair of cycling hand pedals. The seat is supported by the frame and configured to support a user in an at least partially supine position. The sled is movably attached to a first portion of the frame and coupled with a linearly movable resistance load. The pair of cycling hand pedals is attached to a second portion of the frame and independently movable from the sled so that the user can cycle the pair of cycling hand pedals while separately moving the sled with a portion of his or her lower body.

In an exemplary embodiment, the sled is movably attached to the first portion of the frame so that the sled may be moved generally upwardly with respect to the seat.

In an exemplary embodiment, the sled is movably attached to the first portion of the frame so that the sled may be moved away from the base.

According to an exemplary embodiment, a method of physical exercise training comprises: (a) providing a physical exercise apparatus, comprising: a frame; a seat supported by the frame; a sled movably attached to a first portion of the frame and coupled with a linearly movable resistance load; and a pair of cycling hand pedals attached to a second portion of the frame and independently movable from the sled; (b) positioning at least a portion of a body of a user in an at least partially supine position on the seat; (c) accessing by the user the sled from the at least partially supine position; and (d) simultaneously engaging by the user the sled to exercise a portion of an anatomy of the user and independently cycling by the user the pair of cycling hand pedals using a pair of hands of the user while the user is in the at least partially supine position.

In an exemplary embodiment, engaging by the user the sled includes moving the sled generally upwardly with respect to the seat.

BRIEF DESCRIPTION OF THE DRAWINGS

Various exemplary embodiments of this invention will be described in detail, with reference to the following figures, wherein.

DETAILED DESCRIPTION

Figure 1A:
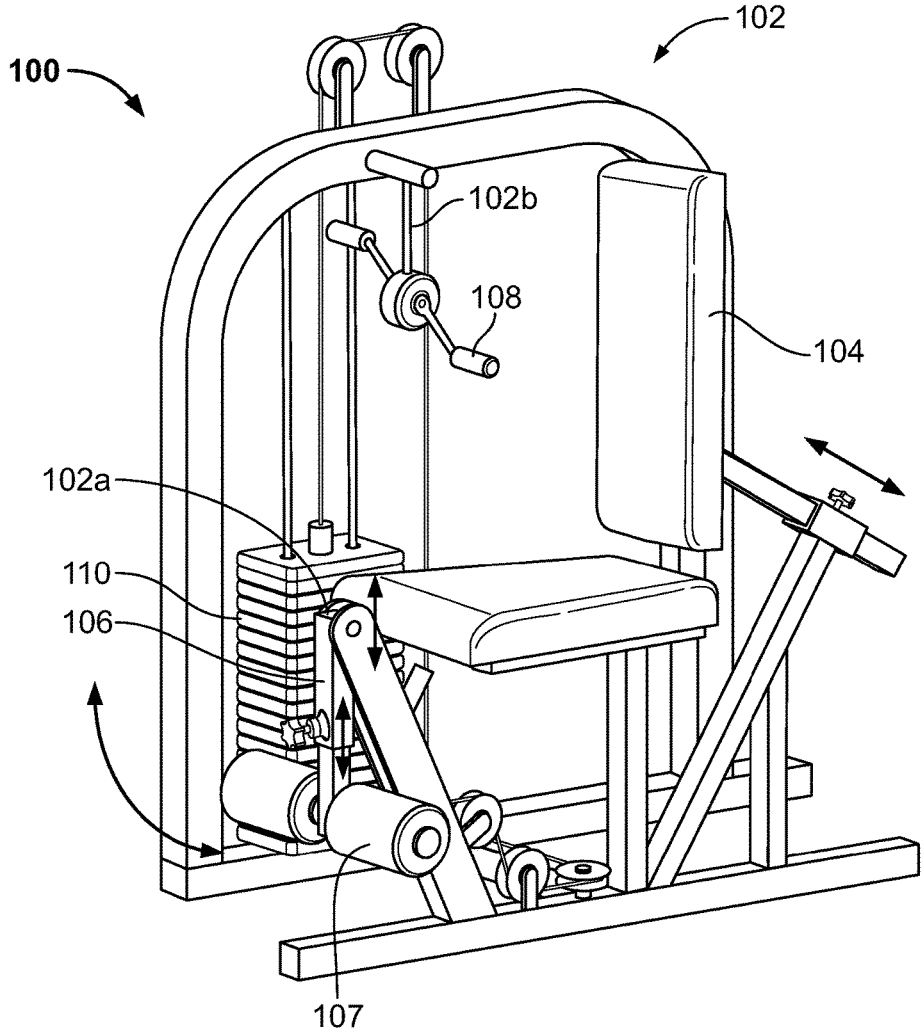
FIG. 1A is a perspective view of a physical exercise apparatus according to an exemplary embodiment of the present disclosure.

The present invention is generally directed towards physical exercise apparatuses and associated methods of use. The present invention generally relates to a physical exercise apparatus and/or method of using the same comprising a lower body target exercise portion and an upper body distraction exercise portion, wherein the target exercise portion and the distraction exercise portion are substantially biomechanically isolated and independently movable from each other, and wherein such movement may position and/or maintain a user's position with respect to the physical exercise apparatus to inhibit, improve, and/or correct muscular imbalances.

The disclosed exercise equipment apparatuses may be configured to provide a distracting exercise to distract a portion of a user's body. In embodiments, a distracting exercise may be configured to generate neuromuscular signals, work, load, and/or otherwise engage a portion of the user's body. In embodiments, a portion of a user's lower body may be targeted for resistance training. In embodiments, a portion of a user's upper body may be a distracted portion of the user's body. In embodiments, a distracted portion of a user's body may be a portion of the user's body that is not being targeted for resistance training.

In embodiments, a distracting exercise may incorporate substantial resistance, such as a strength training exercise. In embodiments, a distracting exercise may provide primarily or exclusively strength training, for example, a distracting exercise may provide substantially little or no cardiovascular training. In embodiments, a distracting exercise may comprise a cycling motion of a user's upper body, and may include flexion and/or extension of the user's arms at the elbow. In embodiments, distraction of one portion of a user's body may facilitate the engagement of deep muscles, ligaments and/or tendons of a target portion of the user's body. Such deep muscles, ligaments and/or tendons may be located within a portion of a user's body at positions deeper below the user's skin than muscles, ligaments, and/or tendons that are typically engaged by a resistance exercise that does not incorporate a distracting exercise.

In embodiments, the disclosed physical exercise apparatuses may provide a user with a configuration of movement and/or positioning that may provide therapeutic benefits for a user, such as maintaining, improving, and/or correcting posture, improving and/or correcting muscular imbalances, maintaining and/or improving a user's flexibility and/or strength, rehabilitation of injuries and/or generally facilitating health and/or healing. A user's posture may include the user's general resting and/or at least partially active biomechanical alignment.

In embodiments, distraction of one portion of the user's body may position the user in a manner so that it is substantially difficult or impossible to achieve an improper position during performance of the target exercise. In embodiments, a distracting exercise may position a user such that it may be substantially difficult for a user to leverage a non-target portion of the user's body against a target muscle portion of the user's body in performing a resistance exercise, maintain an improper posture and/or apply an asymmetrical resistive loading to a target muscle group.

In embodiments, the distraction of one portion of the user's body may tend to position at least a portion of the user's body in a manner such that the user is discouraged from favoring and/or leveraging one portion of a target muscle group against another portion of the target muscle group so that a target muscle group may receive an increased resistive loading as compared to a positioning of the user's body without a distracting exercise. In embodiments, the distraction of one portion of the user's body may tend to position a user in such a manner that a user receives a substantially even resistive loading with respect to an axial midline of the user's body across target muscle groups.

In embodiments, the distraction of one portion of the user's body may position the user in a manner so that the user is inhibited from developing neuromuscular adaptations so that the user may be inhibited from, for example, adapting, becoming bored with, and/or reaching a training plateau, with respect to a target exercise.

FIG. 1A shows a physical exercise apparatus, generally designated by reference number 100, according to an exemplary embodiment of the present disclosure. Physical exercise apparatus 100 includes a frame 102 having a first portion 102*a* and a second portion 102*b*. A seat 104 is supported by the frame 102 and configured to support a user in an at least partially supine position. In embodiments described herein, a user in an at least partially supine position may be in a seated and/or at least partially reclined position.

A movable arm 106 may be movably coupled to the first portion 102*a* of the frame 102. The movable arm 106 may include one or more extensions 107 protruding therefrom for engagement by a user. In embodiments, extensions 107 may be configured to rotate about an axis, such as in a roller, or may be rotationally fixed. In embodiments, extensions 107 may incorporate a softened material for the comfort of a user, for example, foam, rubber, or fabric, to name a few. The movable arm 106 is positioned in front of the seat 104 so that a user may engage the extensions 107 or another portion of movable arm 106 from the at least partially supine position on the seat 104. The user may engage extensions 107 with his or her lower body and move the movable arm 106 to perform, for example, leg extensions with the movable arm 106. The first portion 102*a* of the frame 102 may be substantially stationary with respect to the seat 104 so that the movable arm 106 may be movably coupled to a substantially stationary coupling point on the frame 102. The movable arm 106 is coupled with a linearly movable resistance load 110. In embodiments, resistance load 110 may be an adjustable weight stack. In embodiments, physical exercise apparatus 100 may incorporate more than one movable arm, for example, a pair of independently movable arms. In embodiments, physical exercise apparatus 100 may incorporate more than one resistance load.

A pair of cycling hand pedals 108 may be coupled to the second portion 102*b* of frame 102 and independently movable from the movable arm 106 so that the user can cycle the pair of cycling hand pedals 108 while separately moving the movable arm 106 to perform leg extensions. The second portion 102*b* of the frame 102 may be substantially stationary with respect to the seat 104 so that the cycling hand pedals 108 may be rotatably attached to the frame 102 and movable about a substantially stationary rotation axis. The pair of cycling hand pedals 108 may be positioned in front of the seat 104 and configured for engagement by a portion of a user's upper body, for example, a user's hands.

Figure 1B:
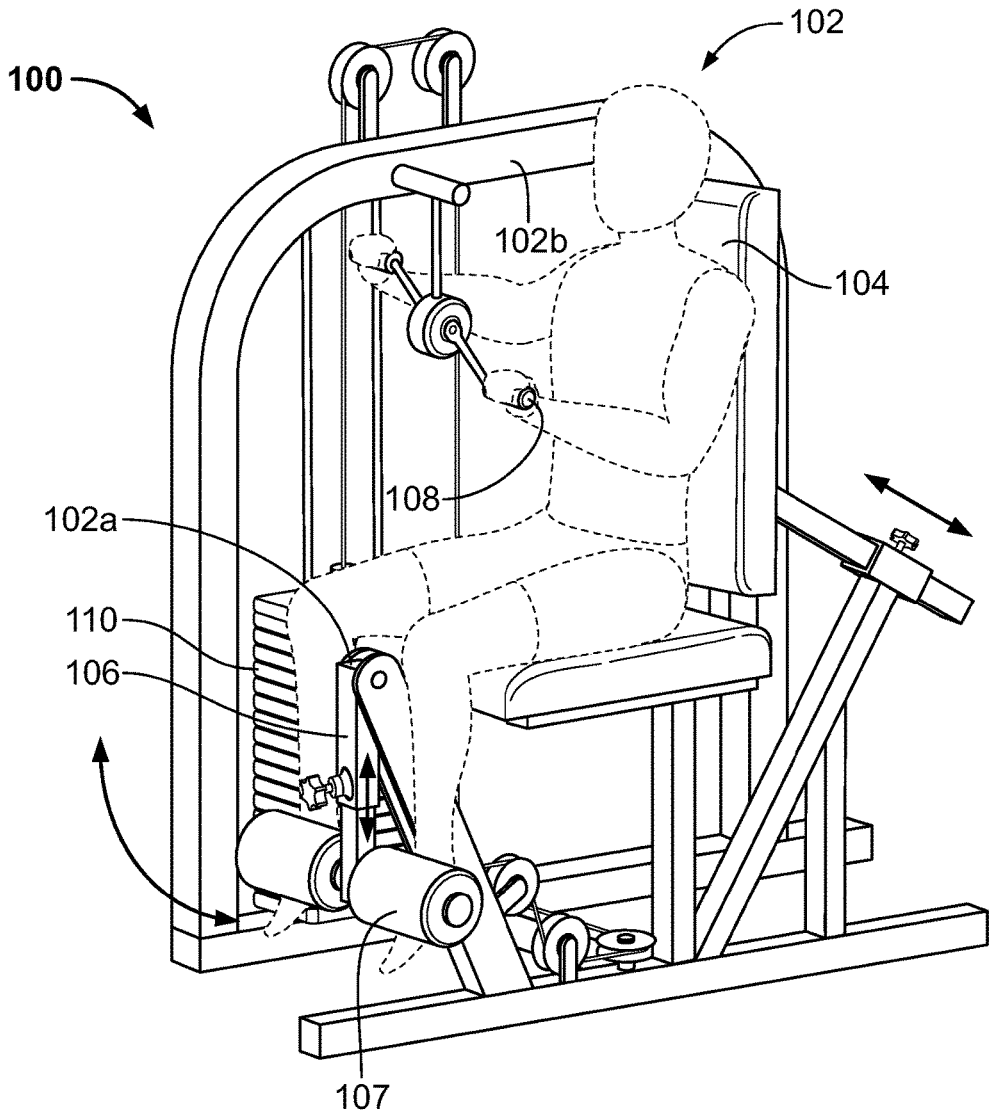
FIG. 1B is a perspective view of the physical exercise apparatus shown in FIG. 1A, with a user disposed thereon.

Referring to FIG. 1B, a method of physical exercise training may comprise providing physical exercise apparatus 100 and positioning at least a portion of a body of a user in an at least partially supine position on the seat 104. The user may access the movable arm 106 from the at least partially supine position by placing his or her feet, ankles, and/or shins under the extensions 107. The user may also grasp the cycling hand pedals 108 with his or her hands from the at least partially supine position.

Figure 1C:
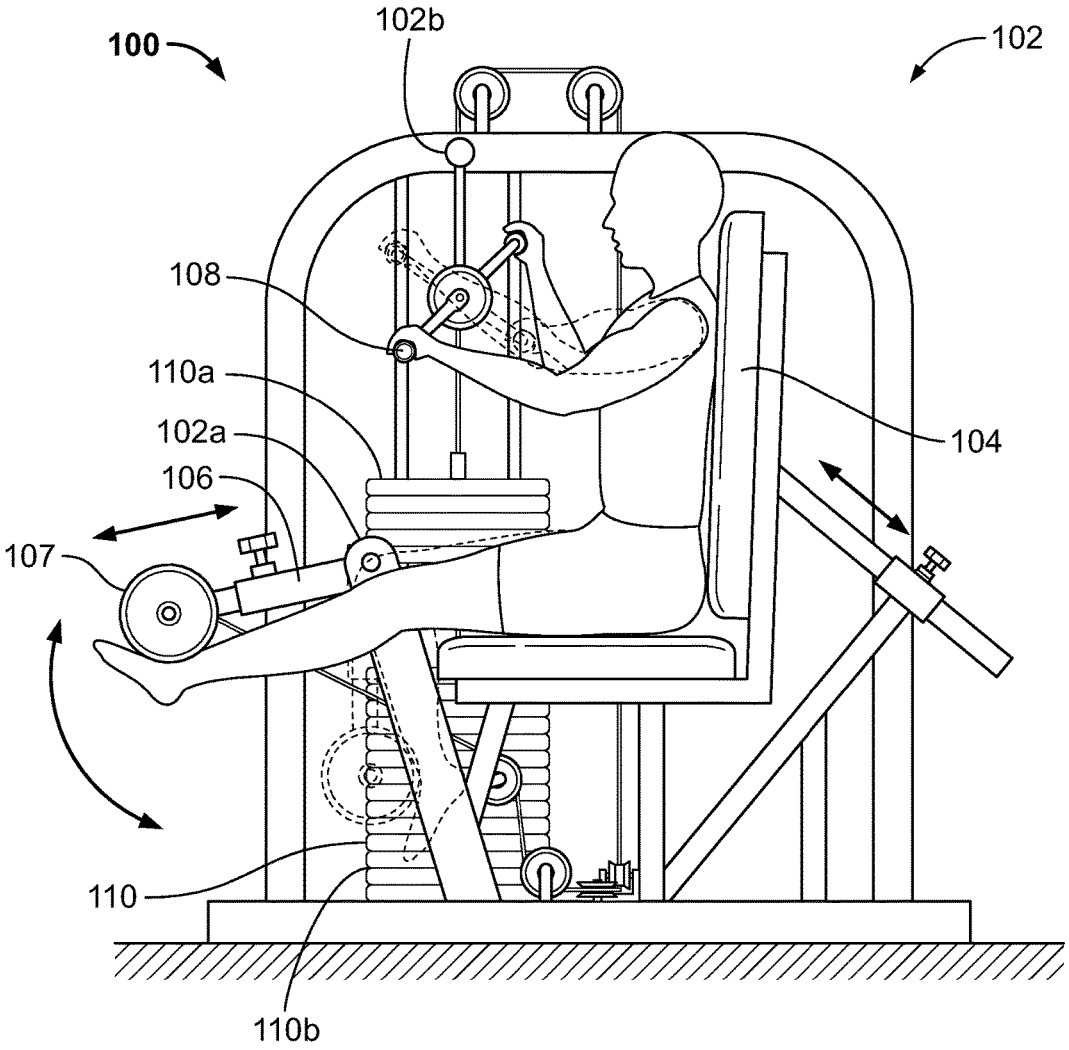
FIG. 1C is a side view of the physical exercise apparatus shown in FIG. 1A being operated by a user.

With reference to FIG. 1C, the user may simultaneously move the movable arm 106 frontally and/or generally upwardly while independently cycling the cycling hand pedals 108 from the at least partially supine position. In embodiments, the user may continuously cycle the pair of cycling hand pedals 108 during movement of the movable arm 106. The user may press on a portion of the movable arm 106, for example, the extensions 107, with a portion of his or her leg, for example, the feet, ankles and/or shins, to move the movable arm 106 frontally and/or generally upwardly and away from the seat 104 to perform leg extensions. Such movement of the movable arm 106 by the user may cause a selected portion 110*a* of the resistance load 110 to linearly move along a portion of the frame 102. An unselected portion 110*b* of the resistance load 110 may remain stationary along the frame 102. In embodiments, a selected portion 110*a* of the resistance load 110 may comprise the entire resistance load 110.

The cycling motion of the user's upper body may provide distraction so that the user is positioned in a manner to perform leg extensions with the movable arm 106 so that a substantially even resistive loading is received by, for example, the user's quadriceps muscles. In this manner, a resistive loading may be transferred to the user's quadriceps muscles that is symmetric about an axial midline of the user's body. Such a resistive loading may minimize, prevent, and/or improve muscular imbalances, and may encourage and/or maintain symmetrical development of muscles with respect to an axial midline of the body within target muscle groups.

In embodiments, the distraction of the upper body caused by the cycling motion of a user's upper body may substantially biomechanically isolate muscles of the upper body so that increased loading is experienced by target muscle groups. In such embodiments, target muscle groups may include the quadriceps muscles. In this manner, a user may be inhibited from twisting, jerking, and/or shifting when using the physical exercise apparatus 100 using muscles of the lower body of the user to leverage muscles of the upper body in performing leg extensions with the movable arm 106.

Figure 2A:
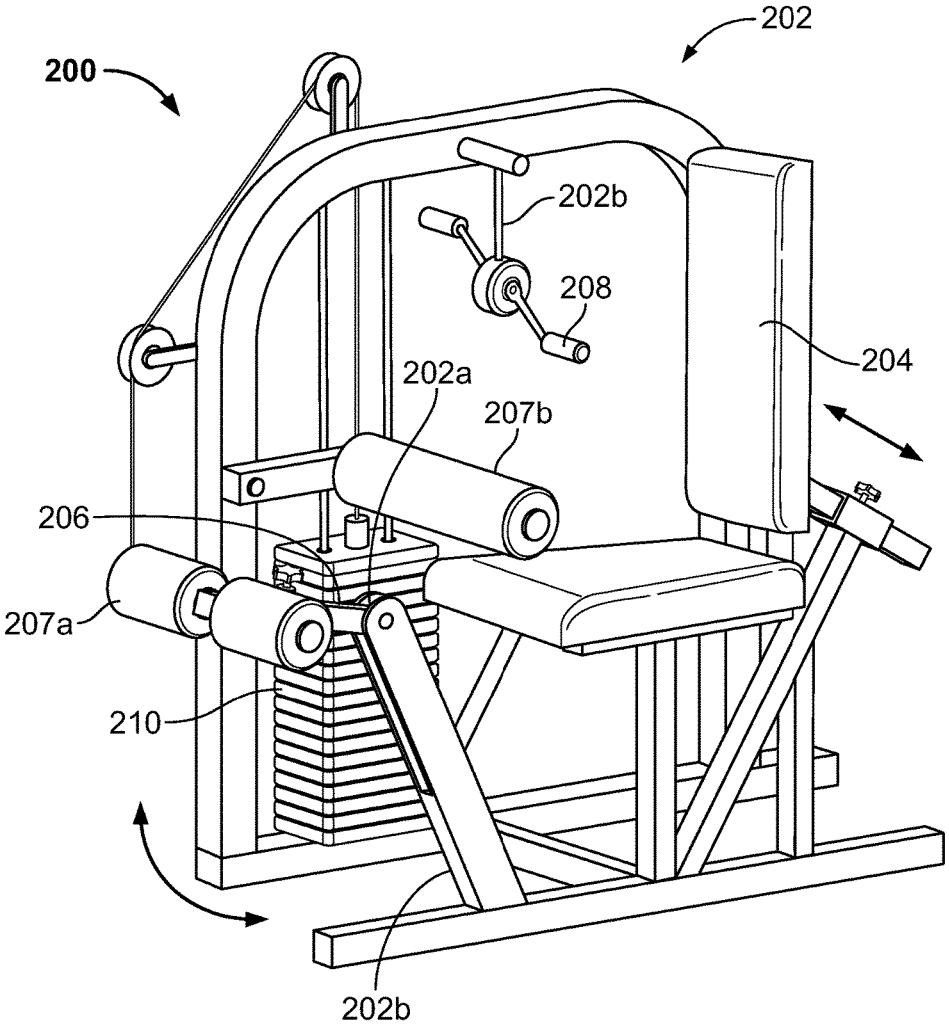
FIG. 2A is a perspective view of a physical exercise apparatus according to an exemplary embodiment of the present disclosure.

FIG. 2A shows a physical exercise apparatus, generally designated by reference number 200, according to an exemplary embodiment of the present disclosure. Physical exercise apparatus 200 may include a frame 202 having a first portion 202*a* and a second portion 202*b*. A seat 204 is supported by the frame 202 and configured to support a user in an at least partially supine position. In embodiments described herein, a user in an at least partially supine position may be in a seated and/or at least partially reclined position.

A movable arm 206 may be movably coupled to the first portion 202*a* of the frame 202. The movable arm 206 may include a pair of extensions 207 extending therefrom for engagement by a user. In embodiments, extensions 207 may be configured to rotate about an axis, such as in a roller, or may be rotationally fixed. In embodiments, extensions 207 may incorporate a softened material, such as padding that incorporates foam, rubber, or fabric, for the comfort of a user. The movable arm 206 is positioned in front of the seat 204 so that a user may engage the extensions 207 or another portion of movable arm 206 from the at least partially supine position on the seat 204. The user may engage extensions 207 with his or her lower body and move the movable arm 206 to perform, for example, leg curls. Physical exercise apparatus 200 may further comprise a bracing arm 209 for maintaining a user's upper leg in a substantially stationary position while the user's lower legs engage and move the movable arm 206.

The first portion 202*a* of the frame 202 may be substantially stationary with respect to the seat 204 so that the movable arm 206 may be movably coupled to a substantially stationary coupling point on the frame 202. The movable arm 206 is coupled with a linearly movable resistance load 210. In embodiments, resistance load 210 may be an adjustable weight stack. In embodiments, physical exercise apparatus 200 may incorporate more than one movable arm, for example, a pair of independently movable arms. In embodiments, physical exercise apparatus 200 may incorporate more than one resistance load.

A pair of cycling hand pedals 208 may be coupled to the second portion 202*b* of frame 202 and independently movable from the movable arm 206 so that the user can cycle the pair of cycling hand pedals 208 while separately moving the movable arm 206 to perform leg curls. The second portion 202*b* of the frame 202 may be substantially stationary with respect to the seat 204 so that the cycling hand pedals 208 may be rotatably attached to the frame 202 and movable about a substantially stationary rotation axis. The pair of cycling hand pedals 208 may be positioned in front of the seat 204 and configured for engagement by a portion of a user's upper body, for example, a user's hands.

Figure 2B:
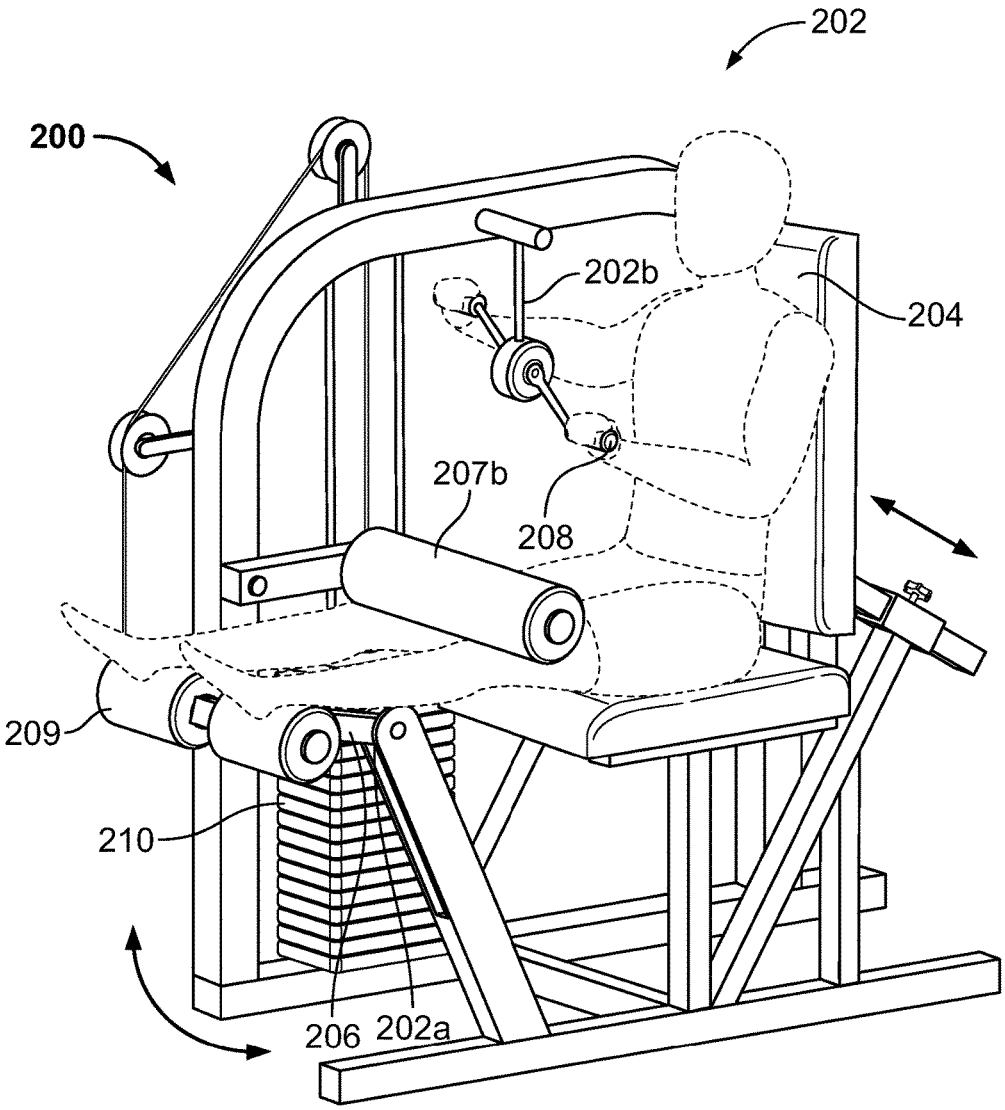
FIG. 2B is a perspective view of the physical exercise apparatus shown in FIG. 2A, with a user disposed thereon.

Referring to FIG. 2B, a method of physical exercise training may comprise providing physical exercise apparatus 200 and positioning at least a portion of a body of a user in an at least partially supine position on the seat 204. The user may access the movable arm 206 from the at least partially supine position by placing a portion of his or her lower leg, for example, feet, ankles, and/or calves, over the extensions 207. The user may further place a portion of his or her mid and/or upper leg below bracing arm 209, for example, the shin, knee and/or thigh. The user may also place his or her hands on the cycling hand pedals 208 from the at least partially supine position.

Figure 2C:
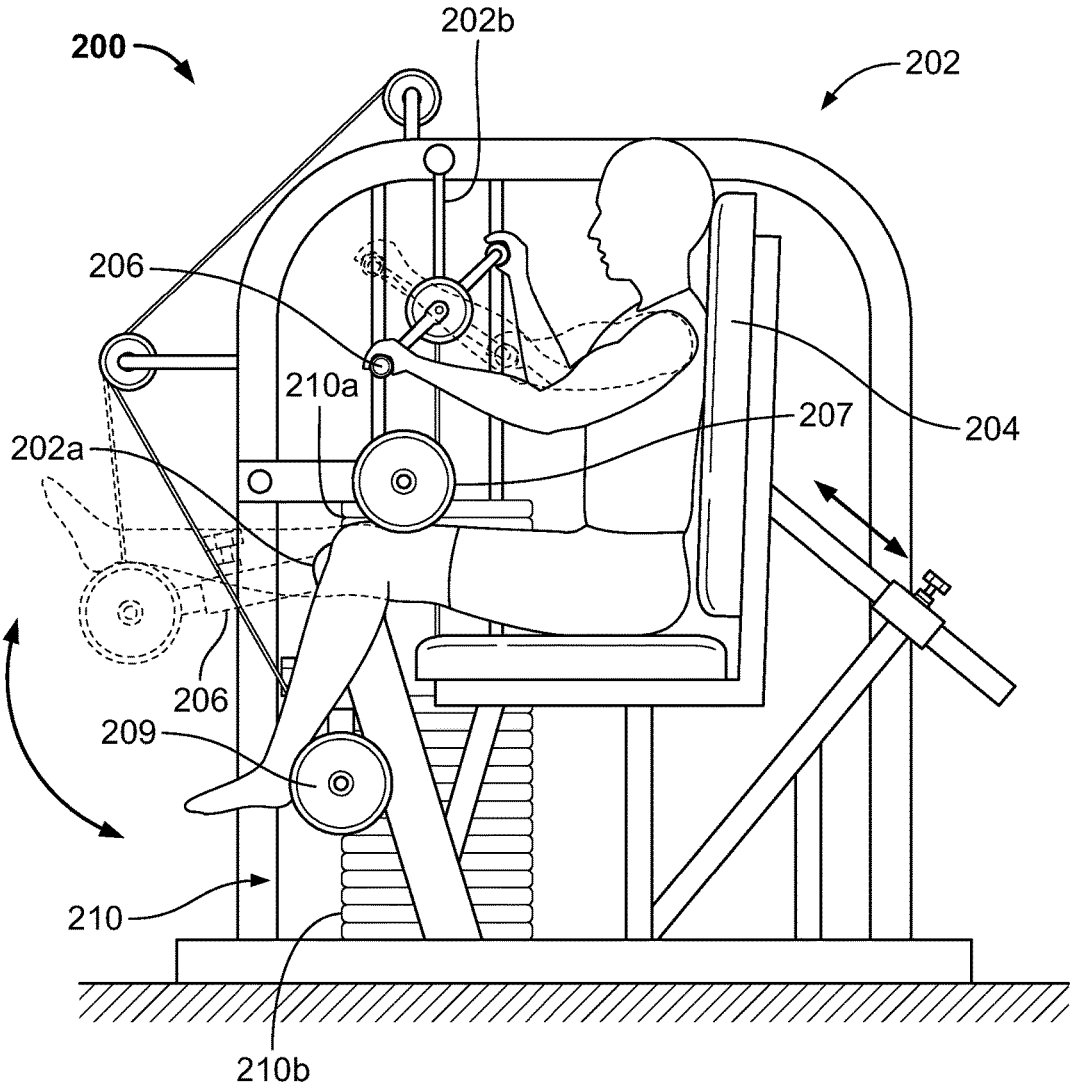
FIG. 2C is a side view of the physical exercise apparatus shown in FIG. 2A being operated by a user.

With reference to FIG. 2C, the user may simultaneously move the movable arm 206 rearward and/or generally downwardly while independently cycling the cycling hand pedals 208 from the at least partially supine position. In embodiments, the user may continuously cycle the pair of cycling hand pedals 208 during movement of the movable arm 206. The user may pull on a portion of the movable arm 206, for example, the extensions 207, with a portion of his or her leg, for example, the feet, ankles and/or shins, to move the movable arm 206 rearward and/or generally downwardly toward the seat 204 to perform leg curls. Such movement of the movable arm 206 by the user may cause a selected portion 210*a* of the resistance load 210 to linearly move along a portion of the frame 202. An unselected portion 210*b* of the resistance load 210 may remain stationary along the frame 202. In embodiments, a selected portion 210*a* of the resistance load 210 may comprise the entire resistance load 210.

The cycling motion of the user's upper body may provide distraction so that the user is positioned in a manner to perform leg curls with the movable arm 206 so that a substantially even resistive loading is received by, for example, the user's hamstring muscles. In this manner, a resistive loading may be transferred to the user's hamstring muscles that is symmetric about an axial midline of the user's body. Such a resistive loading may minimize, prevent and/or improve muscular imbalances, and may encourage and/or maintain symmetrical development of muscles with respect to an axial midline of the body within target muscle groups.

In embodiments, the distraction of the upper body caused by the cycling motion of a user's upper body may substantially biomechanically isolate muscles of the upper body so that increased loading is experienced by target muscle groups. In such embodiments, target muscle groups may include the hamstring muscles. In this manner, a user may be inhibited from twisting, jerking, and/or shifting when using the physical exercise apparatus 200 using muscles of the lower body of the user to leverage muscles of the upper body in performing leg curls with the movable arm 206.

Figure 3A:
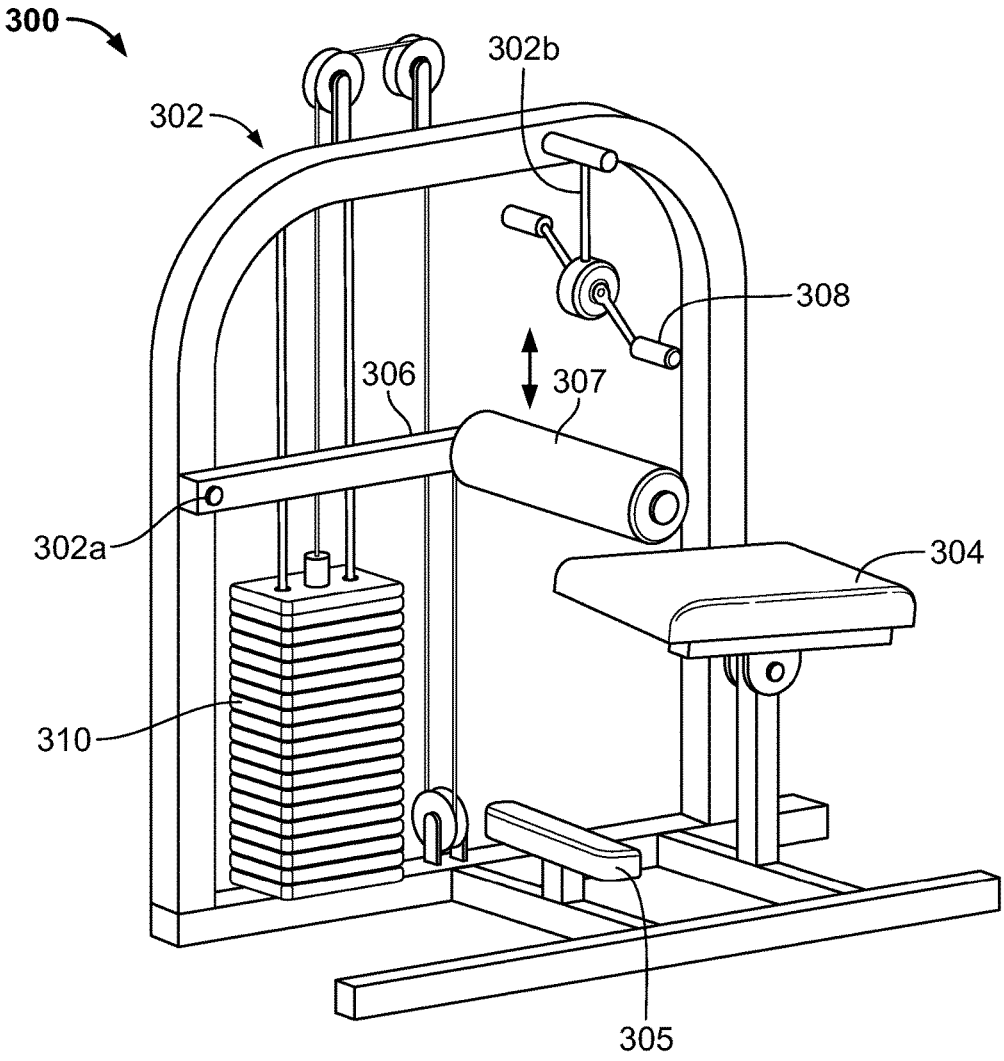
FIG. 3A is a perspective view of a physical exercise apparatus according to an exemplary embodiment of the present disclosure.

FIG. 3A shows a physical exercise apparatus, generally designated by reference number 300, according to an exemplary embodiment of the present disclosure. Physical exercise apparatus 300 includes a frame 302 having a first portion 302*a* and a second portion 302*b*. A seat 304 is supported by the frame 302 and configured to support a user in an at least partially supine position.

A movable arm 306 is movably coupled to the first portion 302*a* of the frame 302. The movable arm 306 may include an extension 307 extending therefrom for engagement by a user. In embodiments, extension 307 may be configured to rotate about an axis, such as in a roller, or may be rotationally fixed. In embodiments, extension 307 may incorporate a softened material, such as padding that incorporates foam, rubber, or fabric, for the comfort of a user. The movable arm 306 is positioned in front of the seat 304 so that a user may engage the extension 307 or another portion of movable arm 306 from the at least partially supine position on the seat 304. The user may engage extension 307 with his or her lower body and perform, for example, calf raises with the movable arm 306. Physical exercise apparatus 300 may further comprise a foot bar 305 for supporting a portion of a user's foot, such as the toes and/or ball of the foot, while allowing upward and downward movement of the heel. In this manner, foot bar 305 provides a surface upon which a user may pivotably raise and lower a part of his or her feet while engaged with the movable arm 306 to perform calf raises, for example, through dorsiflexion.

The first portion 302*a* of the frame 302 may be substantially stationary with respect to the seat 304 so that the movable arm 306 may be movably coupled to a substantially stationary coupling point on the frame 302. The movable arm 306 is coupled with a linearly movable resistance load 310. In embodiments, resistance load 310 may be an adjustable weight stack. In embodiments, physical exercise apparatus 300 may incorporate more than one movable arm, for example, a pair of independently movable arms. In embodiments, physical exercise apparatus 300 may incorporate more than one resistance load.

A pair of cycling hand pedals 308 may be coupled to the second portion 302*b* of frame 302 and independently movable from the movable arm 306 so that the user can cycle the pair of cycling hand pedals 308 while separately moving the movable arm 306 to perform calf raises. The second portion 302*b* of the frame 302 may be substantially stationary with respect to the seat 304 so that the cycling hand pedals 308 may be rotatably attached to the frame 302 and movable about a substantially stationary rotation axis. The pair of cycling hand pedals 308 may be positioned in front of the seat 304 and configured for engagement by a portion of a user's upper body, for example, a user's hands.

Figure 3B:
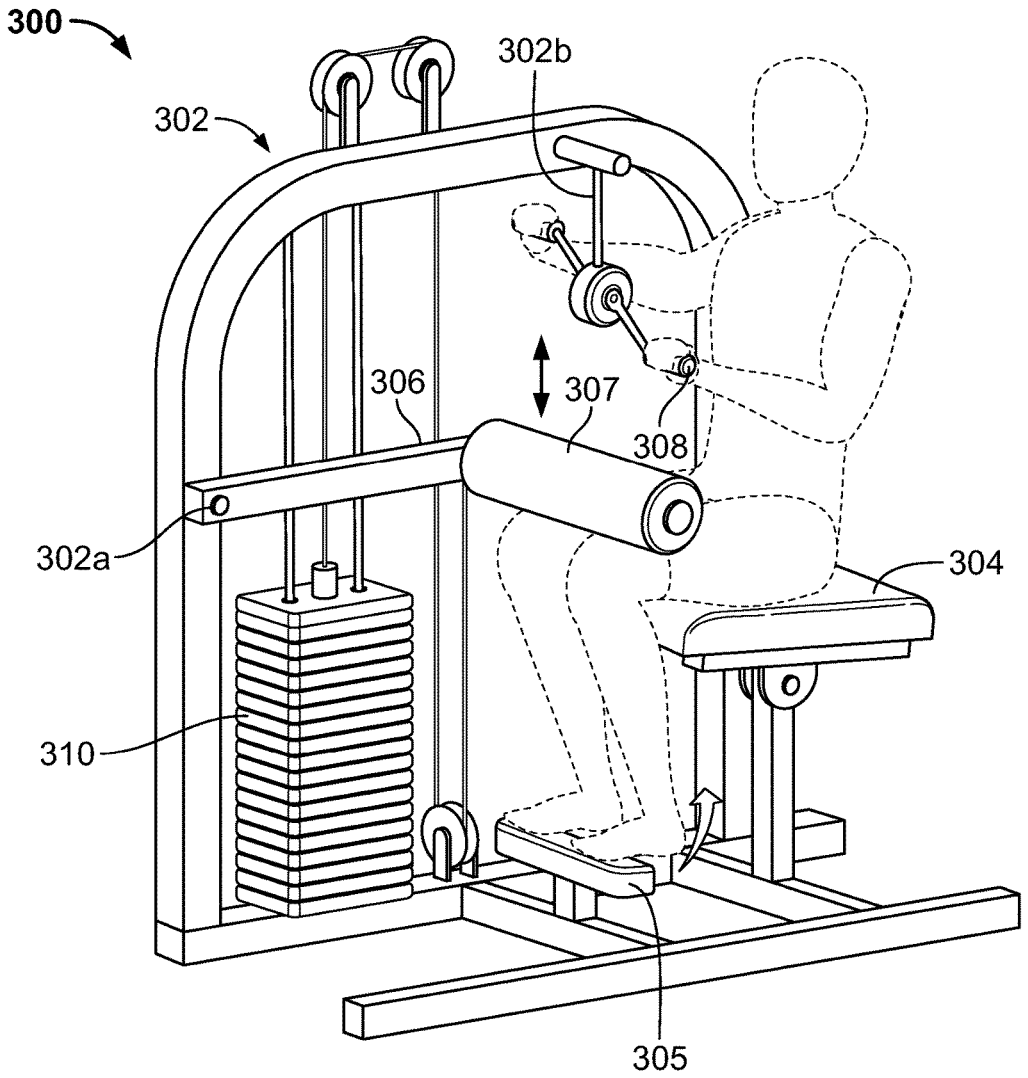
FIG. 3B is a perspective view of the physical exercise apparatus shown in FIG. 3A, with a user disposed thereon.

Referring to FIG. 3B, a method of physical exercise training may comprise providing physical exercise apparatus 300 and positioning at least a portion of a body of a user in an at least partially supine position on the seat 304. The user may access the movable arm 306 from the at least partially supine position by placing a portion of his or her mid and/or upper leg below extension 307, for example, the shin, knee and/or thigh. The user may also place his or her hands on the cycling hand pedals 308 from the at least partially supine position.

Figure 3C:
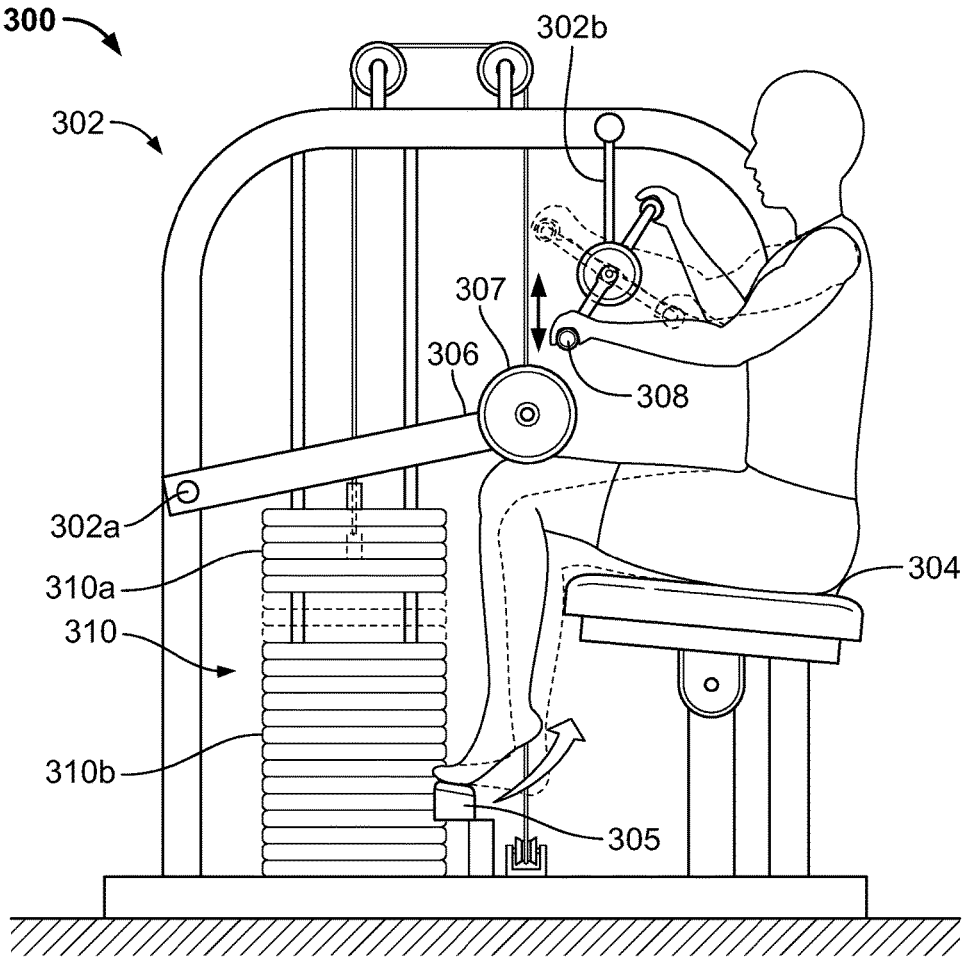
FIG. 3C is a side view of the physical exercise apparatus shown in FIG. 3A being operated by a user.

With reference to FIG. 3C, the user may simultaneously move the movable arm 306 generally upwardly by pivoting his or her feet on the foot bar 305 through dorsiflexion to raise and lower his or her lower legs while independently cycling the cycling hand pedals 308 in the at least partially supine position. In embodiments, the user may continuously cycle the pair of cycling hand pedals 308 during movement of the movable arm 306. Such movement of the movable arm 306 by the user may cause a selected portion 310*a* of the resistance load 310 to linearly move along a portion of the frame 302. An unselected portion 310*b* of the resistance load 310 may remain stationary along the frame 302. In embodiments, a selected portion 310*a* of the resistance load 310 may comprise the entire resistance load 310.

The cycling motion of the user's upper body may provide distraction so that the user is positioned in a manner to perform calf raises with the movable arm 306 so that a substantially even resistive loading is received by, for example, the user's gastrocnemius and/or soleus muscles. In this manner, a resistive loading may be transferred to the user's gastrocnemius and/or soleus muscles that is symmetric about an axial midline of the user's body. Such a resistive loading may minimize, prevent and/or improve muscular imbalances, and may encourage and/or maintain symmetrical development of muscles with respect to an axial midline of the body within target muscle groups.

In embodiments, the distraction of the upper body caused by the cycling motion of a user's upper body may substantially biomechanically isolate muscles of the upper body so that increased loading is experienced by target muscle groups. In such embodiments, target muscle groups may include the gastrocnemius and/or soleus muscles. In this manner, a user may be inhibited from twisting, jerking, and/or shifting when using the physical exercise apparatus 300 using muscles of the lower body of the user to leverage muscles of the upper body in performing calf raises with the movable arm 306.

Figure 4A:
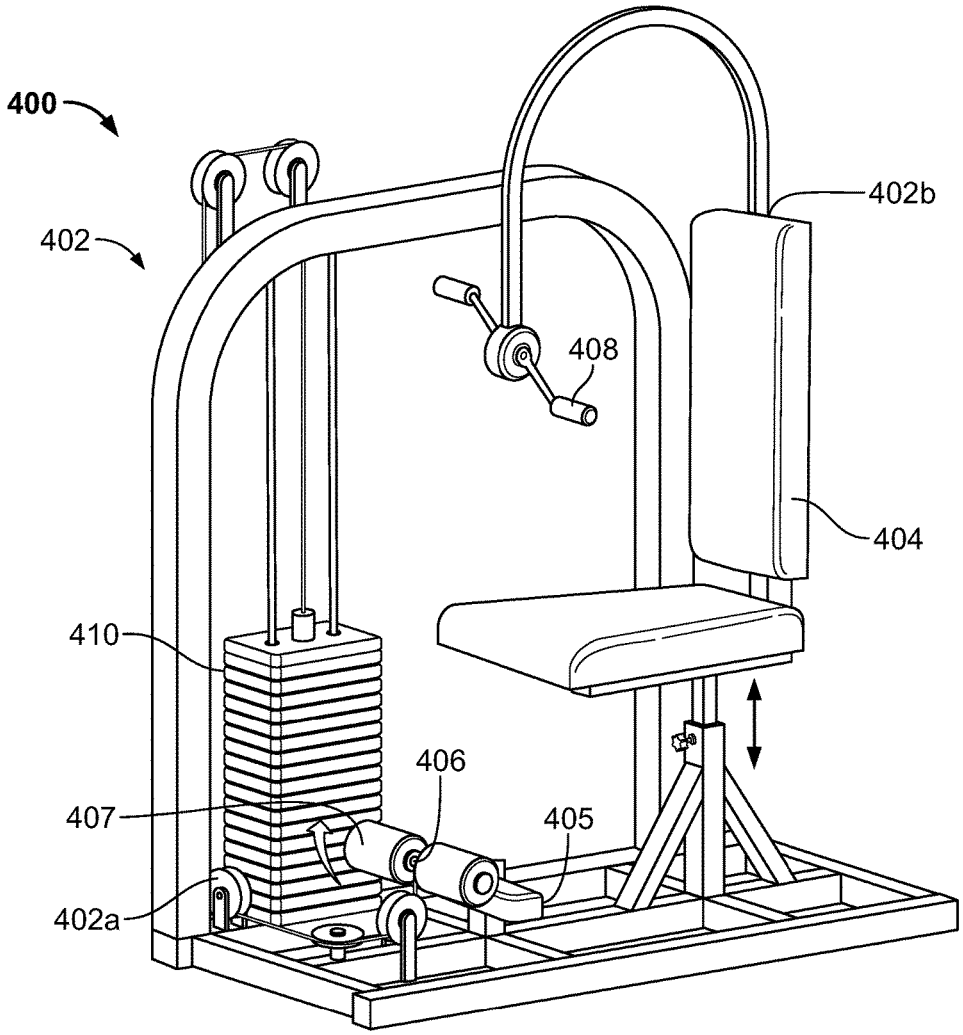
FIG. 4A is a perspective view of a physical exercise apparatus according to an exemplary embodiment of the present disclosure.

FIG. 4A shows a physical exercise apparatus, generally designated by reference number 400, according to an exemplary embodiment of the present disclosure. Physical exercise apparatus 400 includes a frame 402 having a first portion 402*a* and a second portion 402*b*. A seat 404 is supported by the frame 402 and configured to support a user in an at least partially supine position.

A movable arm 406 is movably coupled to the first portion 402*a* of the frame 402. The movable arm 406 may include a pair of extensions 407 extending therefrom for engagement by a user. In embodiments, extensions 407 may be configured to rotate about an axis, such as in a roller, or may be rotationally fixed. In embodiments, extensions 407 may incorporate a softened material, such as padding that incorporates foam, rubber, or fabric, for the comfort of a user. The movable arm 406 is positioned in front of the seat 404 so that a user may engage the extensions 407 with his or her lower body to move the movable arm 406 and perform, for example, tibialis raises. Physical exercise apparatus 400 may further comprise a foot bar 405 for supporting a portion of a user's foot, such as the heel of the foot, while allowing upward and downward movement of the frontal portion of the foot, for example, through plantarflexion. In this manner, foot bar 405 provides a surface upon which a user may pivotably raise and lower a frontal portion of his or her feet while engaged with the movable arm 406 to perform tibialis raises.

The first portion 402*a* of the frame 402 may be substantially stationary with respect to the seat 404 so that the movable arm 406 may be movably coupled to a substantially stationary coupling point on the frame 402. The movable arm 406 is coupled with a linearly movable resistance load 410. In embodiments, resistance load 410 may be an adjustable weight stack. In embodiments, physical exercise apparatus 400 may incorporate more than one movable arm, for example, a pair of independently movable arms. In embodiments, physical exercise apparatus 400 may incorporate more than one resistance load.

A pair of cycling hand pedals 408 may be coupled to the second portion 402*b* of frame 402 and independently movable from the movable arm 406 so that the user can cycle the pair of cycling hand pedals 408 while separately moving the movable arm 406 to perform tibialis raises. The second portion 402*b* of the frame 402 may be substantially stationary with respect to the seat 404 so that the cycling hand pedals 408 may be rotatably attached to the frame 402 and movable about a substantially stationary rotation axis. The pair of cycling hand pedals 408 may be positioned in front of the seat 404 and configured for engagement by a portion of a user's upper body, for example, a user's hands.

Figure 4B:
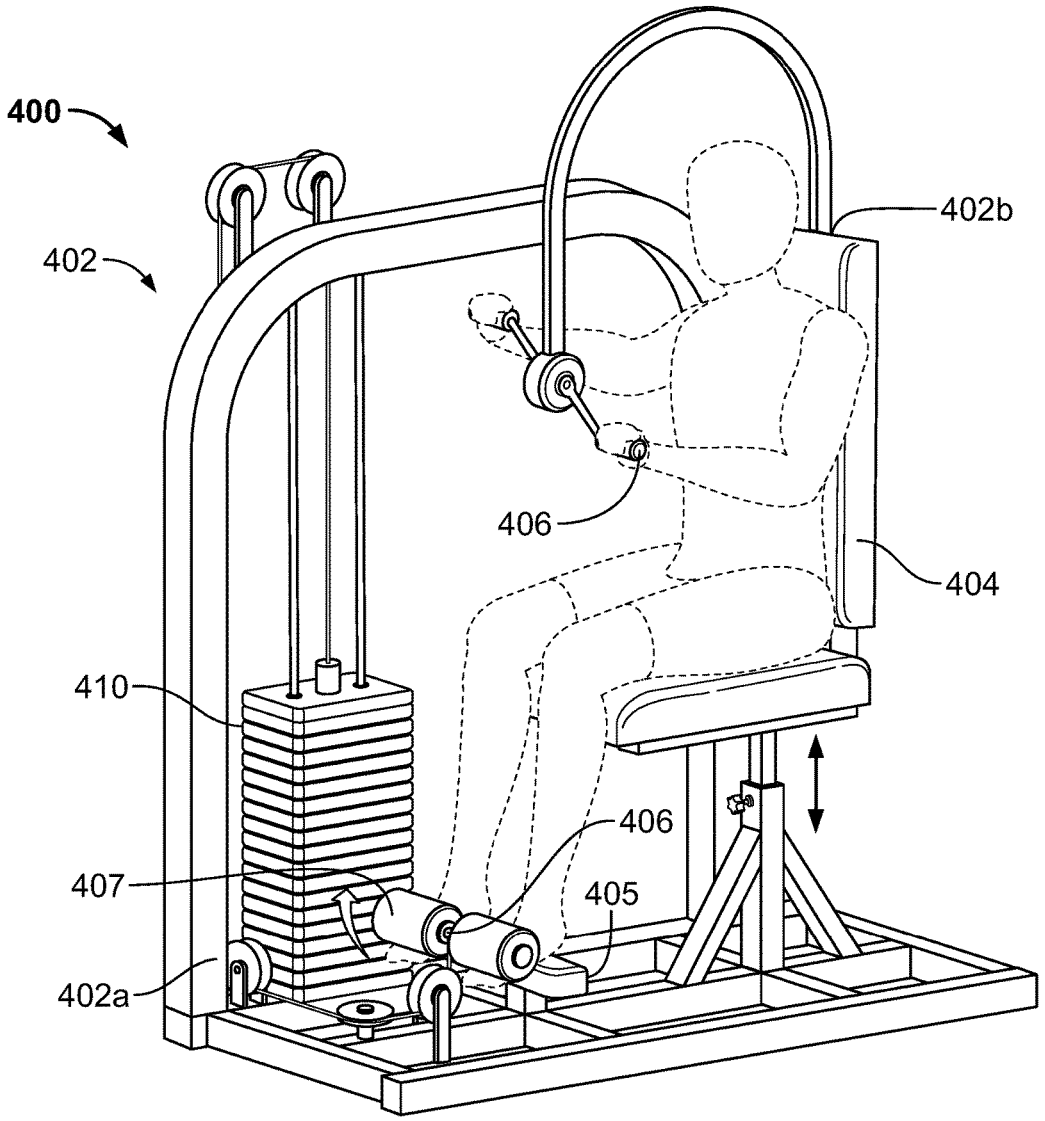
FIG. 4B is a perspective view of the physical exercise apparatus shown in FIG. 4A, with a user disposed thereon.

Referring to FIG. 4B, a method of physical exercise training may comprise providing physical exercise apparatus 400 and positioning at least a portion of a body of a user in an at least partially supine position on the seat 404. The user may access the movable arm 406 from the at least partially supine position by placing a portion of his or her feet, for example, the top frontal portion of his or her feet, below extensions 407 with the user's heels resting on foot bar 405. The user may also grasp cycling hand pedals 408 with his or hands from the at least partially supine position.

Figure 4C:
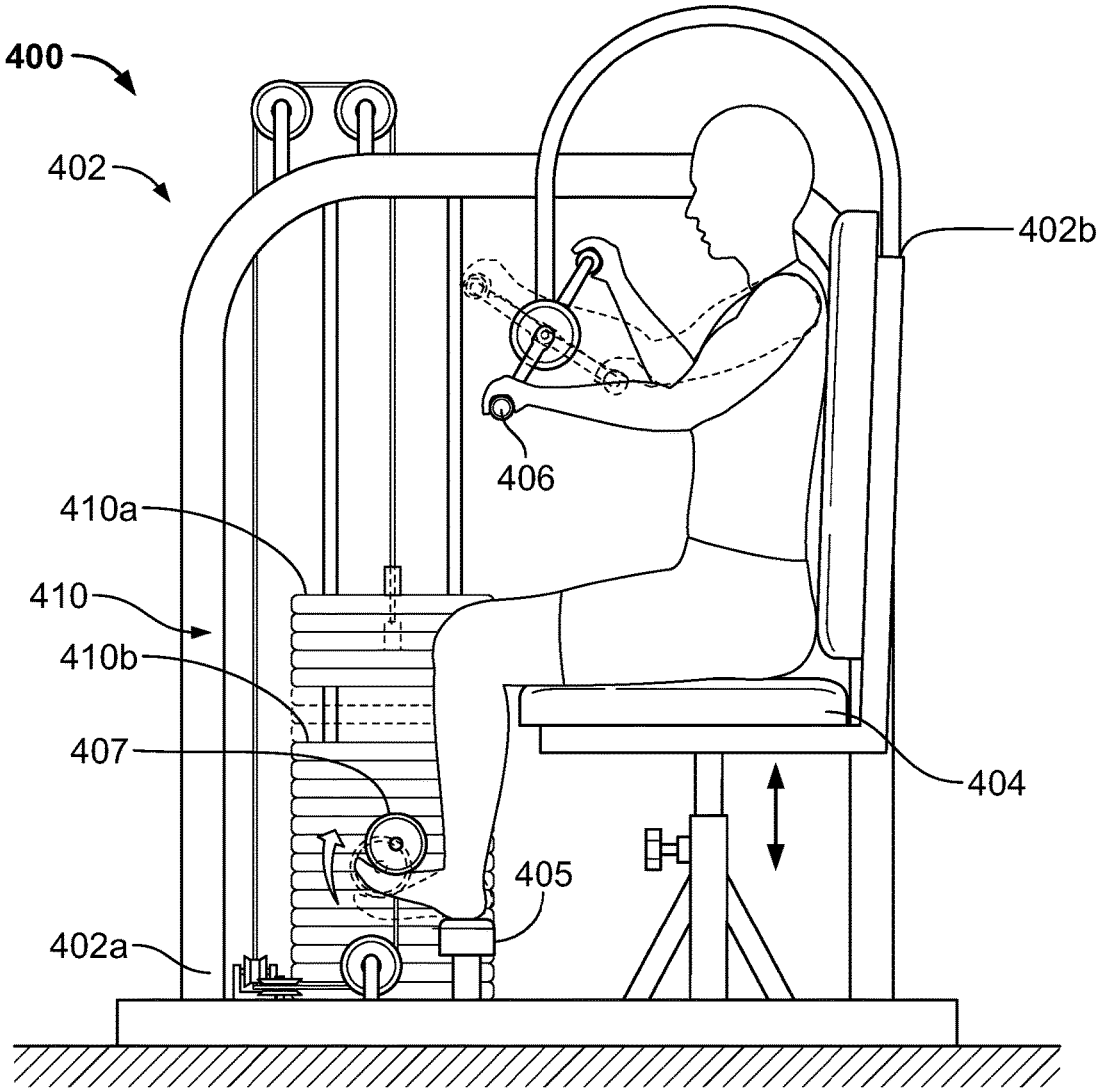
FIG. 4C is a side view of the physical exercise apparatus shown in FIG. 4A being operated by a user.

With reference to FIG. 4C, the user may simultaneously move the movable arm 406 generally upwardly by pivoting his or her feet on the foot bar 405 through plantarflexion to raise and lower his or her lower legs while independently cycling the cycling hand pedals 408 from the at least partially supine position. In embodiments, the user may continuously cycle the pair of cycling hand pedals 408 during movement of the movable arm 406. Such movement of the movable arm 406 by the user may cause a selected portion 410*a* of the resistance load 410 to linearly move along a portion of the frame 402. An unselected portion 410*b* of the resistance load 410 may remain stationary along the frame 402. In embodiments, a selected portion 410*a* of the resistance load 410 may comprise the entire resistance load 410.

The cycling motion of the user's upper body may provide distraction so that the user is positioned to perform tibialis raises with the movable arm 406 so that a substantially even resistive loading is received by, for example, the user's tibialis anterior muscles. In this manner, a resistive loading may be transferred to the user's tibialis anterior muscles that is symmetric about an axial midline of the user's body. Such a resistive loading may minimize, prevent and/or improve muscular imbalances, and may encourage and/or maintain symmetrical development of muscles with respect to an axial midline of the body within target muscle groups.

In embodiments, the distraction of the upper body caused by the cycling motion of a user's upper body may substantially biomechanically isolate muscles of the upper body so that increased loading is experienced by target muscle groups. In such embodiments, target muscle groups may include the tibialis anterior muscles. In this manner, a user may be inhibited from twisting, jerking, and/or shifting when using the physical exercise apparatus 400 using muscles of the lower body of the user to leverage muscles of the upper body in performing tibialis raises with the movable arm 406.

Figure 5A:
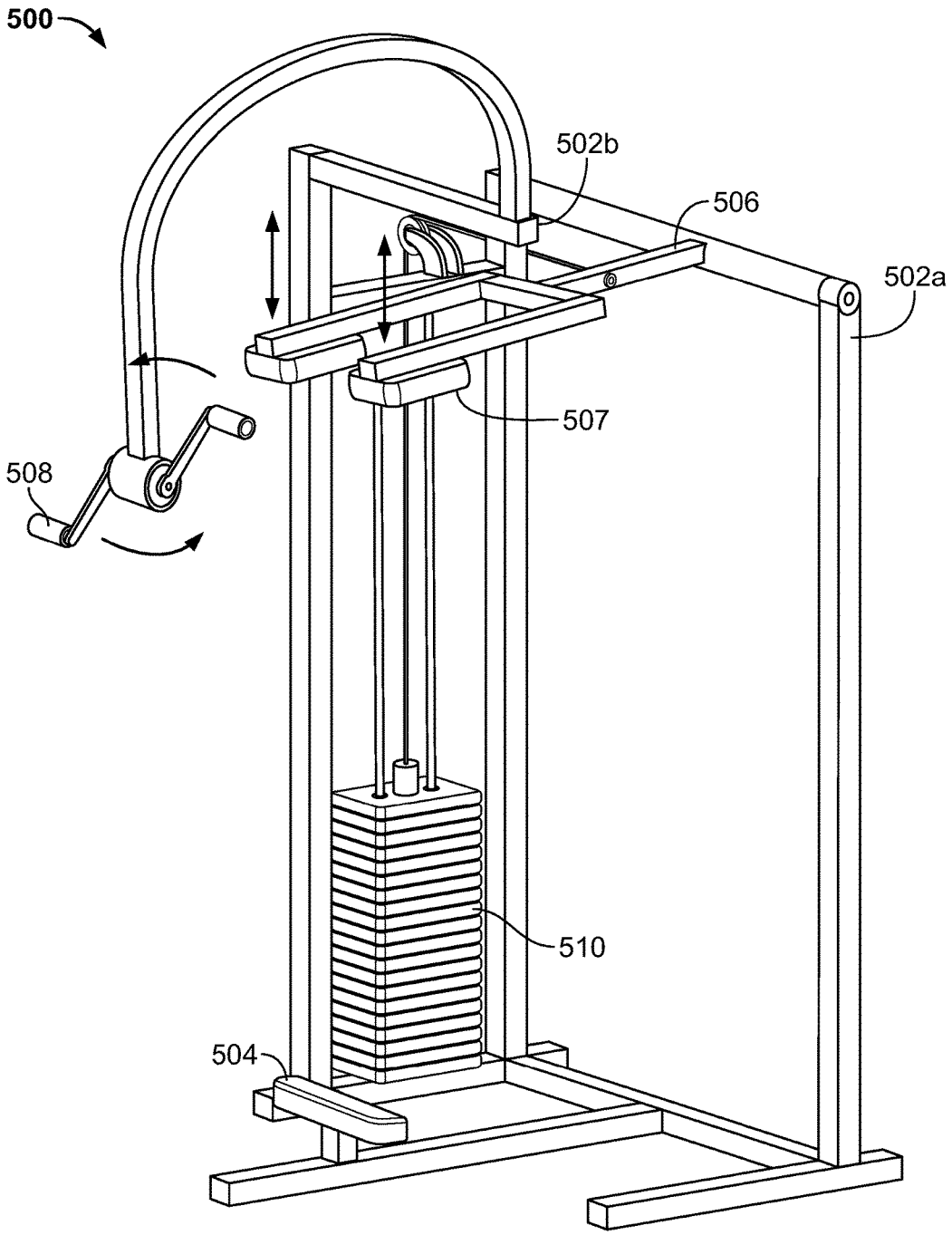
FIG. 5A is a perspective view of a physical exercise apparatus according to an exemplary embodiment of the present disclosure.

FIG. 5A shows a physical exercise apparatus, generally designated by reference number 500, according to an exemplary embodiment of the present disclosure. Physical exercise apparatus 500 includes a frame 502 having a first portion 502*a* and a second portion 502*b*. A base 504 is supported by the frame 502 and configured to support a user in an at least partially upright position. In embodiments described herein, a user in an at least partially upright position may be fully standing, leaning, and/or standing with an at least partial bend at the waist and/or knees. In embodiments, base 504 may be dimensioned to support only a portion of a user, for example the toes and/or balls of a user's feet.

A movable arm 506 is movably coupled to the first portion 502*a* of the frame 502. The movable arm 506 may include a pair of extensions 507 extending therefrom for engagement by a user. In embodiments, extensions 507 may incorporate a softened material, such as padding that incorporates foam, rubber, or fabric, for the comfort of a user. The movable arm 506 is positioned above the base 504 so that a user may engage the extensions 507 or another portion of movable arm 506 from the at least partially upright position on the base 504. The user may engage extensions 507 with a portion of his or her upper body so that a user can perform, for example, standing calf raises while engaged with the movable arm 506.

The first portion 502*a* of the frame 502 may be substantially stationary with respect to the seat 504 so that the movable arm 506 may be movably coupled to a substantially stationary coupling point on the frame 502. The movable arm 506 is coupled with a linearly movable resistance load 510. In embodiments, resistance load 510 may be an adjustable weight stack. In embodiments, physical exercise apparatus 400 may incorporate more than one movable arm, for example, a pair of independently movable arms. In embodiments, physical exercise apparatus 500 may incorporate more than one resistance load.

A pair of cycling hand pedals 508 may be coupled to the second portion 502*b* of frame 502 and independently movable from the movable arm 506 so that the user can cycle the pair of cycling hand pedals 508 while separately moving the movable arm 506 to perform standing calf raises. The second portion 502*b* of the frame 502 may be substantially stationary with respect to the base 504 so that the cycling hand pedals 508 may be rotatably attached to the frame 502 and movable about a substantially stationary rotation axis. The pair of cycling hand pedals 508 may be positioned above the base 504 and configured for engagement by a portion of a user's upper body, for example, a user's hands.

Figure 5B:
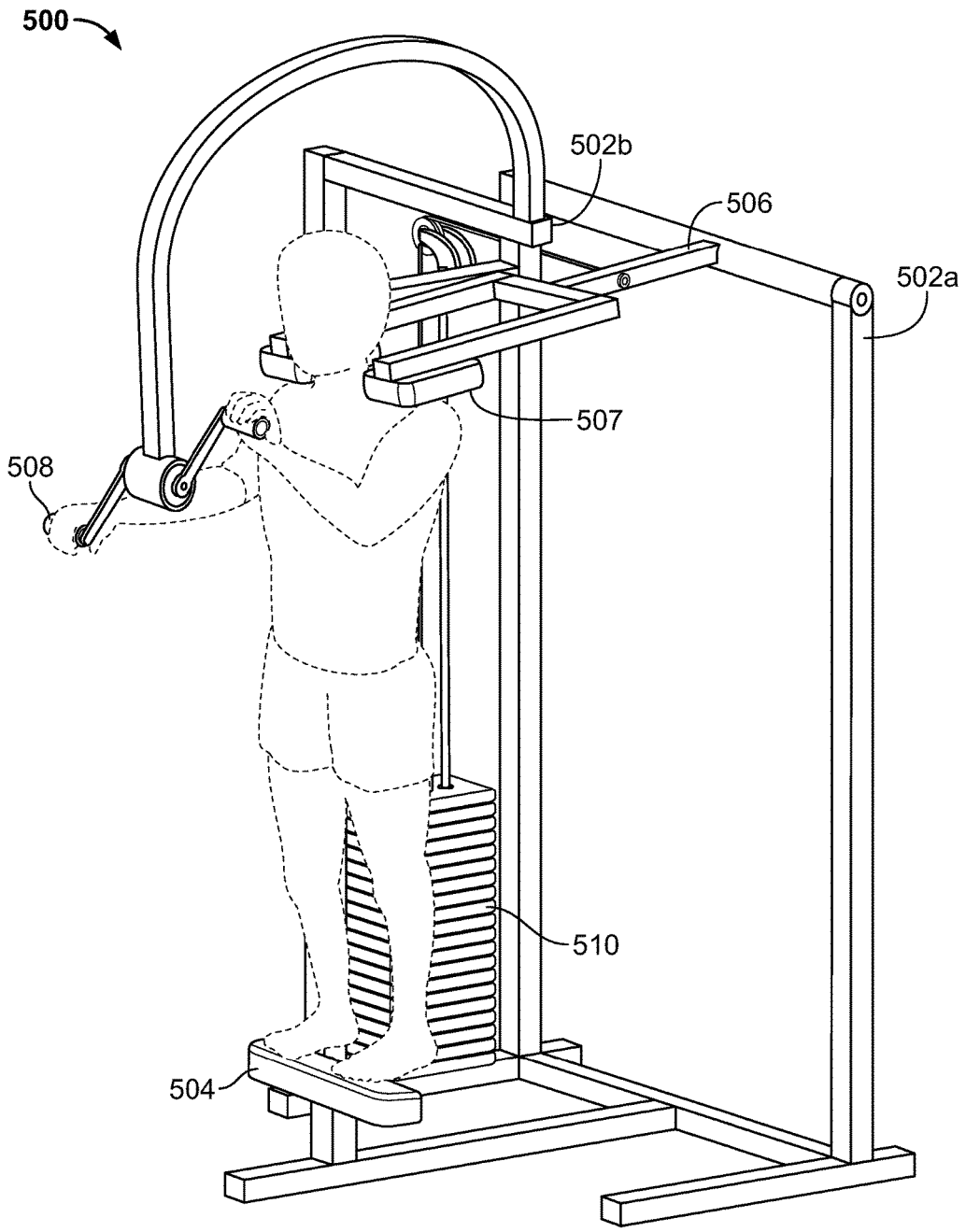
FIG. 5B is a perspective view of the physical exercise apparatus shown in FIG. 5A, with a user disposed thereon.

Referring to FIG. 5B, a method of physical exercise training may comprise providing the physical exercise apparatus 500 and positioning at least a portion of a body of a user in an at least partially upright position on the base 504. The user may access the movable arm 506 with the user in the at least partially upright position. The user may access the movable arm 506 by placing a portion of his or her body, for example, his or her shoulders, under the extensions 507. In this manner, the user's head extends upwardly through a gap between extensions 507. The user may also place his or her hands on the cycling hand pedals 508 with the user in the at least partially upright position.

Figure 5C:
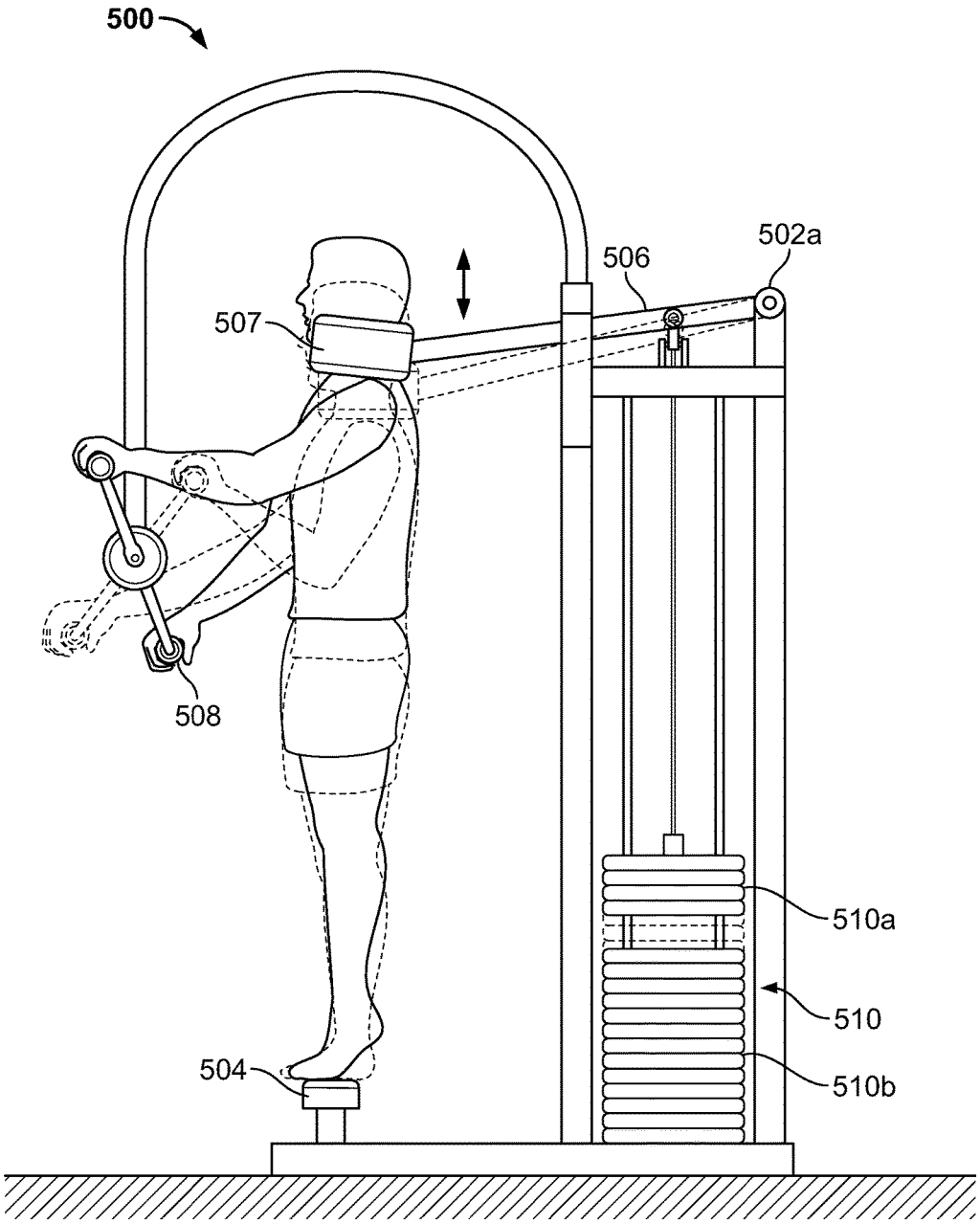
FIG. 5C is a side view of the physical exercise apparatus shown in FIG. 5A being operated by a user.

With reference to FIG. 5C, the user may simultaneously move the movable arm 506 generally upwardly by raising the heels of his or her feet upwardly off the base 504 through dorsiflexion to raise and movable arm 506 while independently cycling the cycling hand pedals 508 from the at least partially upright position. In this manner, the user pivots the frontal portion of his or her feet on the base 504 to raise and lower the movable arm 506. In embodiments, the user may continuously cycle the pair of cycling hand pedals 508 during movement of the movable arm 506. Such movement of the movable arm 506 by the user may cause a selected portion 510*a* of the resistance load 510 to linearly move along a portion of the frame 502. An unselected portion 510*b* of the resistance load 510 may remain stationary along the frame 502. In embodiments, a selected portion 510*a* of the resistance load 510 may comprise the entire resistance load 510.

The cycling motion of the user's upper body may provide distraction so that the user is positioned in a manner to perform standing calf raises with the movable arm 506 so that a substantially even resistive loading is received by, for example, the user's gastrocnemius and/or soleus muscles. In this manner, a resistive loading may be transferred to the user's gastrocnemius and/or soleus muscles that is symmetric about an axial midline of the user's body. Such a resistive loading may minimize, prevent and/or improve muscular imbalances, and may encourage and/or maintain symmetrical development of muscles with respect to an axial midline of the body within target muscle groups.

In embodiments, the distraction of the upper body caused by the cycling motion of a user's upper body may substantially biomechanically isolate muscles of the upper body so that increased loading is experienced by target muscle groups. In such embodiments, target muscle groups may include the gastrocnemius and/or soleus muscles. In this manner, a user may be inhibited from twisting, jerking, and/or shifting when using the physical exercise apparatus 500 using muscles of the lower body of the user to leverage muscles of the upper body in performing standing calf raises with the movable arm 506.

Figure 6A:
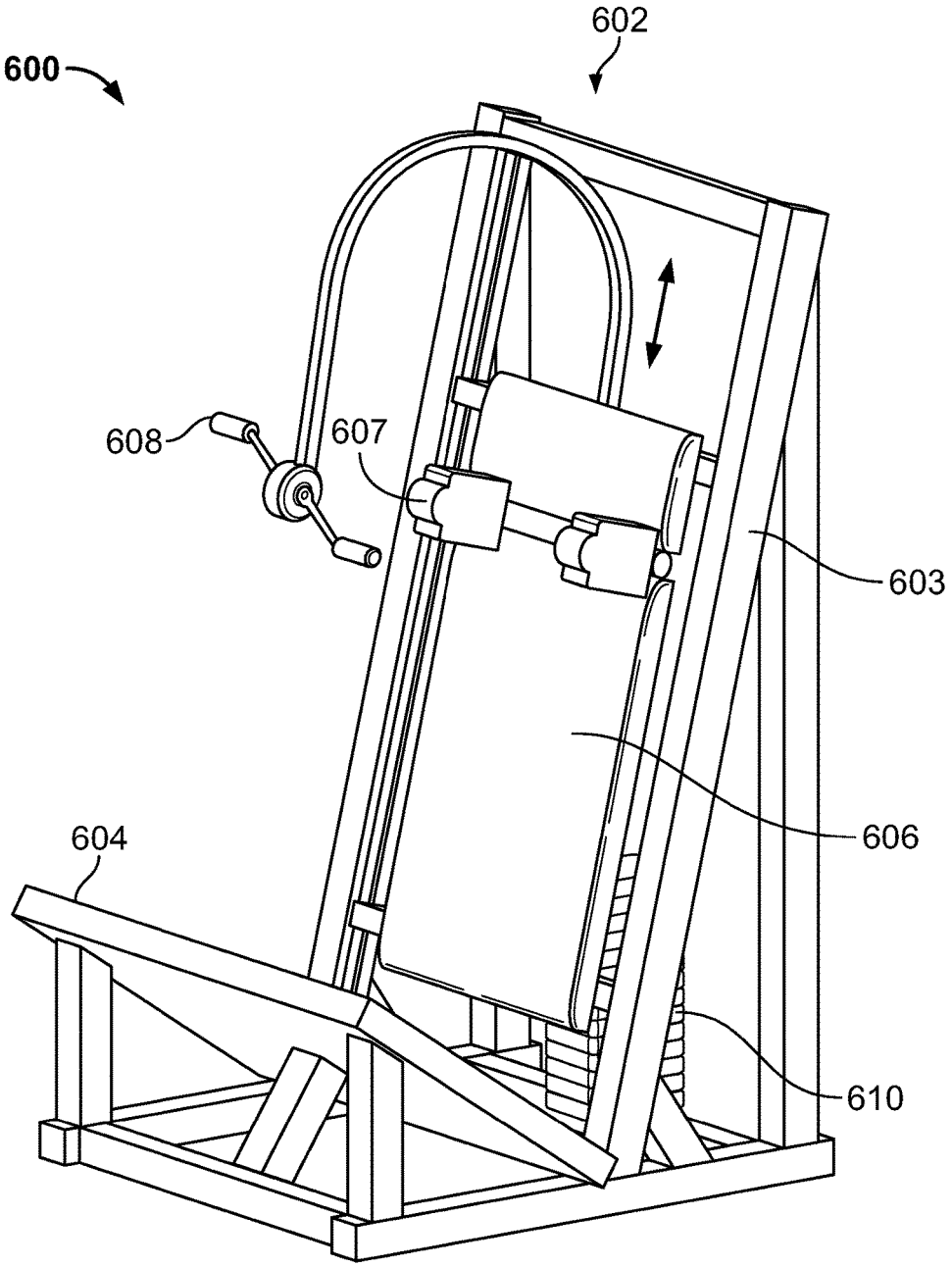
FIG. 6A is a perspective view of a physical exercise apparatus according to an exemplary embodiment of the present disclosure.

FIG. 6A shows a physical exercise apparatus, generally designated by reference number 600, according to an exemplary embodiment of the present disclosure. Physical exercise apparatus 600 includes a frame 602 having a first portion 602*a* and a second portion 602*b*. A base 604 is supported on the first portion 602*a* of the frame 602 and configured to support a user in an at least partially upright position. Base 604 may be configured at an incline relative to a flat surface supporting frame 602. In embodiments, base 604 may be reclined at an angle of about 45 degrees relative to a surface supporting frame 602. In embodiments, base 604 may be disposed at a different angle relative to a surface supporting frame 602.

A movable sled 606 is movably coupled to the second portion 602*b* of the frame 602 so that the movable sled 606 is slidable along the second portion 602*b* of the frame 602. In embodiments, movable sled 606 may be movably coupled to frame 602, for example, in a wheel and track configuration. Movable sled 606 may be reclined with respect to a flat surface supporting frame 602. In embodiments, movable sled 606 may be reclined at an angle of about 25 degrees relative to a flat surface supporting frame 602. In embodiments, movable sled 606 may be disposed at a different angle relative to a surface supporting frame 602.

Figure 6B:
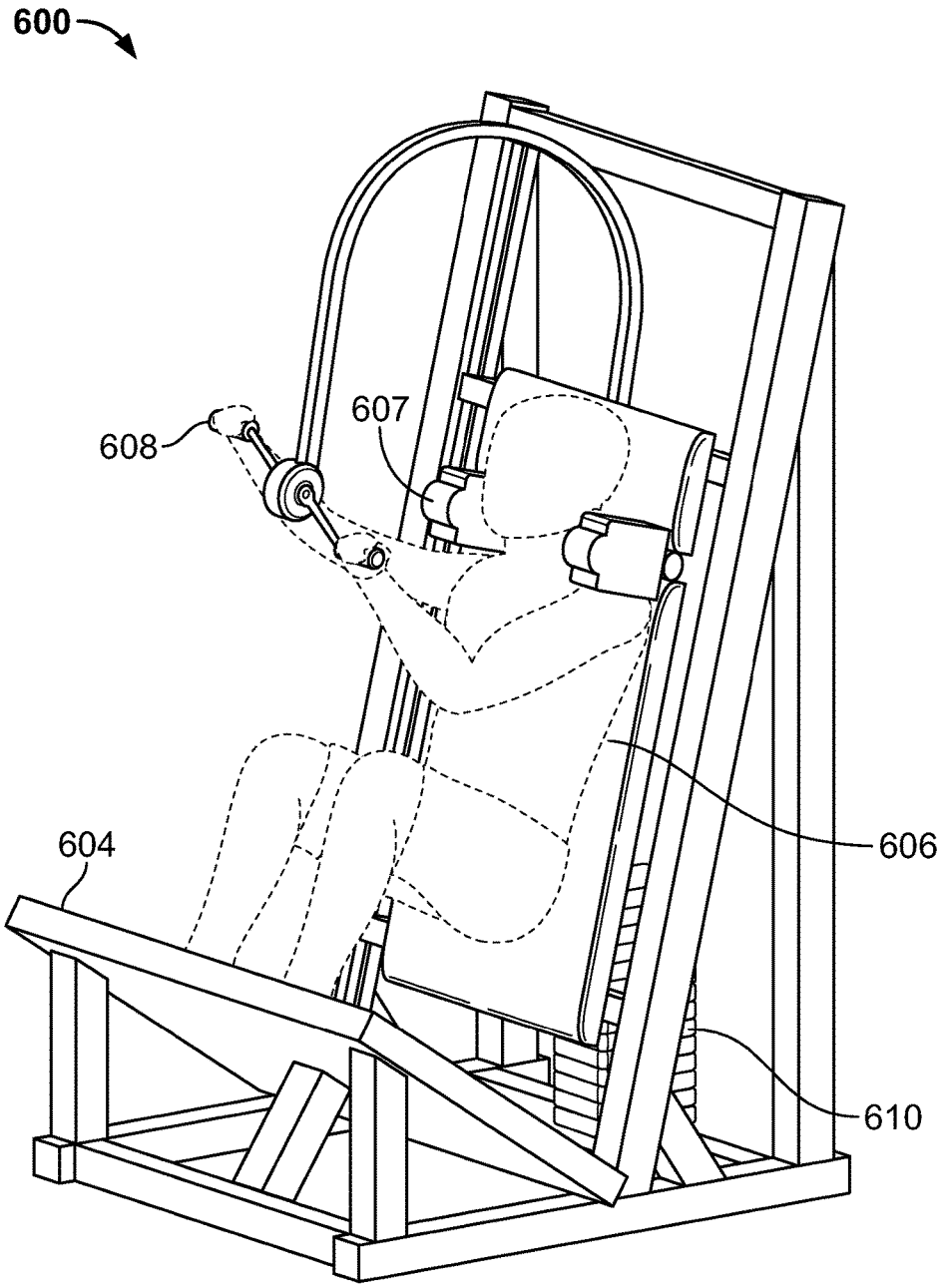
FIG. 6B is a perspective view of the physical exercise apparatus shown in FIG. 6A, with a user disposed thereon.

The movable sled 606 may include a pair of extensions 607 extending therefrom for engagement by a user. In embodiments, extensions 607 may incorporate a softened material, such as padding that incorporates foam, rubber, or fabric, for the comfort of a user. The movable sled 606 is positioned above the base 604 so that a user may engage the extensions 607 or another portion of movable sled 606 from the at least partially upright position on the base 604 such as while the user faces forward and the user's back is positioned against the sled as shown in FIG. 6B. The user may engage extensions 607 with a portion of his or her upper body, for example, by placing his or her head through a gap between extensions 607 so that extensions 607 rest on the user's shoulders. In this manner, a user can perform, for example, hack squats while engaged with the movable sled 606.

The movable sled 606 is coupled with a linearly movable resistance load 610 so that at least a portion of movable resistance load can be raised and lowered in concert with the movable sled 606. In embodiments, resistance load 610 may be an adjustable weight stack. In embodiments, resistance load 610 may be a free weight placed along a portion of movable sled 606.

A pair of cycling hand pedals 608 may be coupled to the movable sled 606 and independently movable from the movable sled 606 so that the user can cycle the pair of cycling hand pedals 608 while separately moving the movable sled 606 to perform hack squats. The pair of cycling hand pedals 608 may be positioned above the base 604 and configured for engagement by a portion of a user's upper body, for example, a user's hands.

Referring to FIG. 6B, a method of physical exercise training may comprise providing physical exercise apparatus 600 and positioning at least a portion of a body of a user in an at least partially upright position on the base 604, with the user facing forward, as shown in FIG. 6B, such that the user's back is positioned against the sled. The user may access the movable sled 606 from the at least partially upright position by placing his or her shoulders, under the extensions 607. The user may also grasp the cycling hand pedals 606 with his or her hands from the at least partially upright position.

Figure 6C:
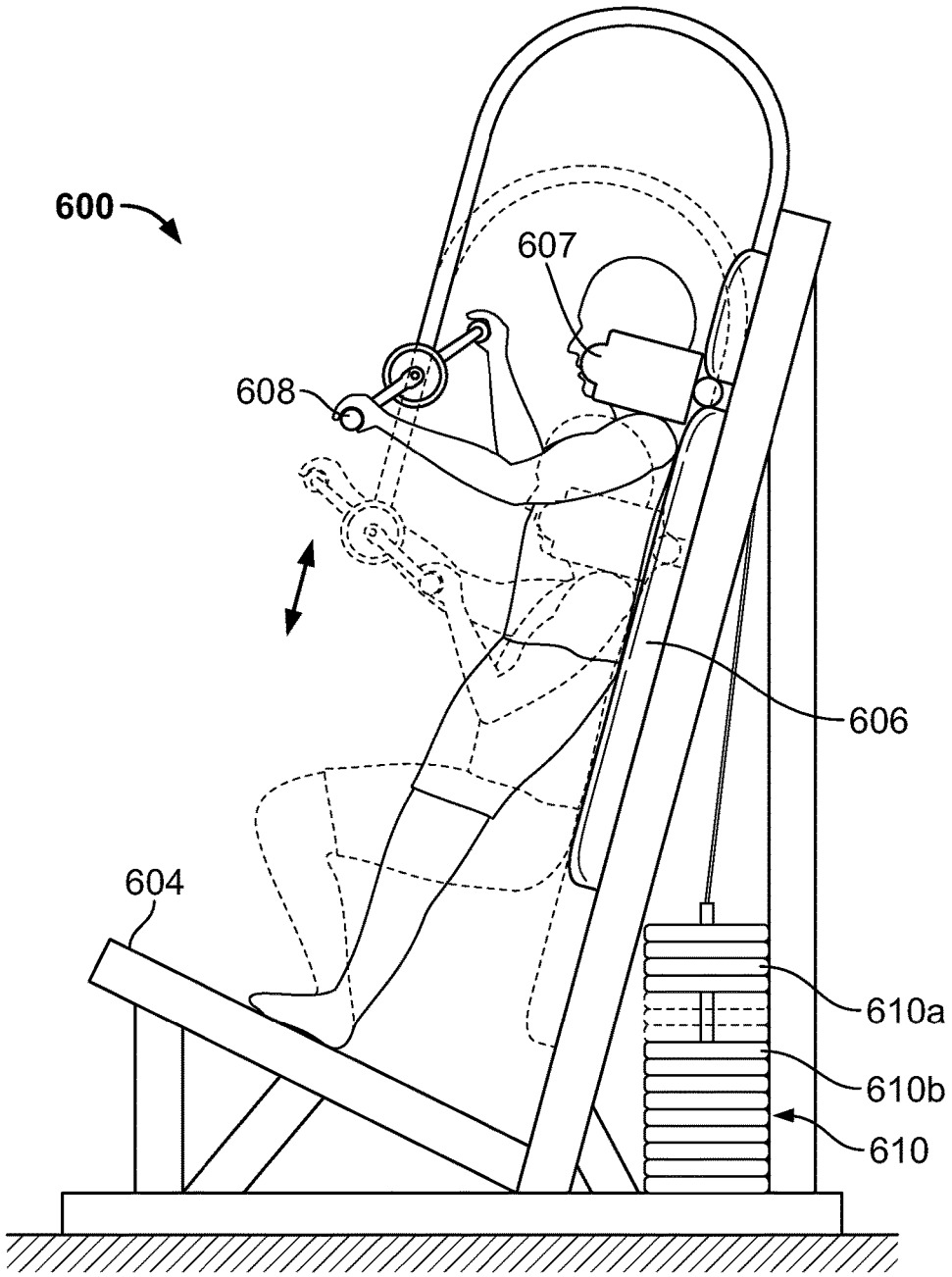
FIG. 6C is a side view of the physical exercise apparatus shown in FIG. 6A being operated by a user.

With reference to FIG. 6C, the user may simultaneously move the movable sled 606 generally upwardly by driving his or her feet into the base 604 to raise the movable sled 606 while independently cycling the cycling hand pedals 608 with the user in the at least partially upright position. In embodiments, the user may continuously cycle the pair of cycling hand pedals 608 during movement of the movable sled 606. Such movement of the movable arm 606 by the user may cause a selected portion 610*a* of the resistance load 610 to linearly move along a portion of the frame 602. An unselected portion 610*b* of the resistance load 610 may remain stationary along the frame 602. In embodiments, a selected portion 610*a* of the resistance load 610 may comprise the entire resistance load 610.

The cycling motion of the user's upper body may provide distraction so that the user is positioned in a manner to perform hack squats with the movable sled 606 so that a substantially even resistive loading is received by, for example, the user's gluteus and/or quadriceps muscles. In this manner, a resistive loading may be transferred to the user's gluteus and/or quadriceps muscles that is symmetric about an axial midline of the user's body. Such a resistive loading may minimize, prevent and/or improve muscular imbalances, and may encourage and/or maintain symmetrical development of muscles with respect to an axial midline of the body within target muscle groups.

In embodiments, the distraction of the upper body caused by the cycling motion of a user's upper body may substantially biomechanically isolate muscles of the upper body so that increased loading is experienced by target muscle groups. In such embodiments, target muscle groups may include the gluteus and/or quadriceps muscles. In this manner, a user may be inhibited from twisting, jerking, and/or shifting when using the physical exercise apparatus 600 using muscles of the lower body of the user to leverage muscles of the upper body in performing hack squats with the movable sled 606.

Figure 7A:
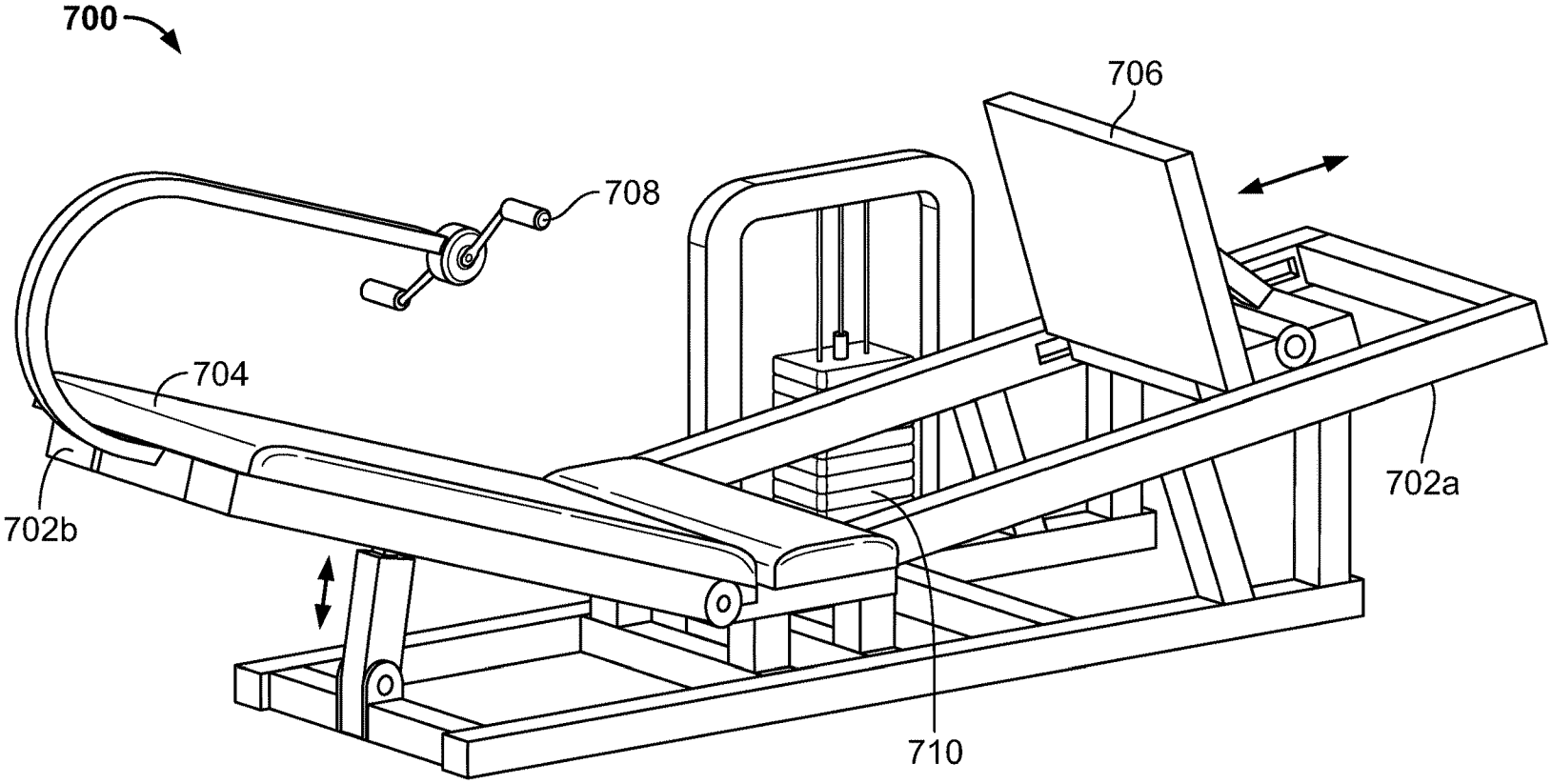
FIG. 7A is a perspective view of a physical exercise apparatus according to an exemplary embodiment of the present disclosure.

FIG. 7A shows a physical exercise apparatus, generally designated by reference number 700, according to an exemplary embodiment of the present disclosure. Physical exercise apparatus 700 includes a frame 702 having a first portion 702*a* and a second portion 702*b*. A seat 704 is supported by the frame 702 and configured to support a user in an at least partially supine position. Seat 704 may be reclined relative to a flat surface supporting frame 702. In embodiments, seat 704 may be reclined at an angle of about 135 degrees relative to a flat surface supporting frame 702. In embodiments, seat 704 may be disposed at a different angle relative to a surface supporting frame 702.

A movable sled 706 may be movably coupled to the first portion 702*a* of the frame 702 so that the movable sled 706 can slide along the first portion 702*a* of the frame 702. In embodiments, movable sled 706 and first portion 702*a* of frame 702 may be movably coupled, for example, in a wheel and track configuration. The first portion 702*a* of the frame 702 may be substantially stationary with respect to the seat 704 so that the movable sled 706 may be movably coupled to a substantially stationary coupling point on the frame 702. Movable sled 706 may be inclined with respect to a flat surface supporting frame 702. In embodiments, movable sled 706 may be reclined at an angle of about 45 degrees relative to a surface supporting frame 702. In embodiments, movable sled 706 may be disposed at a different angle relative to a surface supporting frame 702. The movable sled 706 is positioned in front of the seat 704 so that a user may engage the movable sled 706 from the at least partially upright position on the seat 704. The user may engage movable sled 706 with a portion of his or her lower body, for example, his or her feet, so that a user can perform, for example, leg presses while engaged with the movable sled 706.

The movable sled 706 is coupled with a linearly movable resistance load 710 so that at least a portion of movable resistance load can be raised and lowered in concert with the movable sled 706. In embodiments, resistance load 710 may be an adjustable weight stack. In embodiments, resistance load 710 may be a free weight placed along a portion of movable sled 606.

A pair of cycling hand pedals 708 may be coupled to the second portion 702*b* of frame 702 and independently movable from the movable sled 706 so that the user can cycle the pair of cycling hand pedals 708 while separately moving the movable sled 706 to perform leg presses. The second portion 702*b* of the frame 702 may be substantially stationary with respect to the seat 704 so that the cycling hand pedals 708 may be rotatably attached to the frame 702 and movable about a substantially stationary rotation axis. The pair of cycling hand pedals 708 may be positioned above the seat 704 and configured for engagement by a portion of a user's upper body, for example, a user's hands. In embodiments, the cycling hand pedals 708 may be mounted in an adjustable manner on the frame 702 so that cycling hand pedals 708 may be moved, for example, to accommodate users of different heights.

Figure 7B:
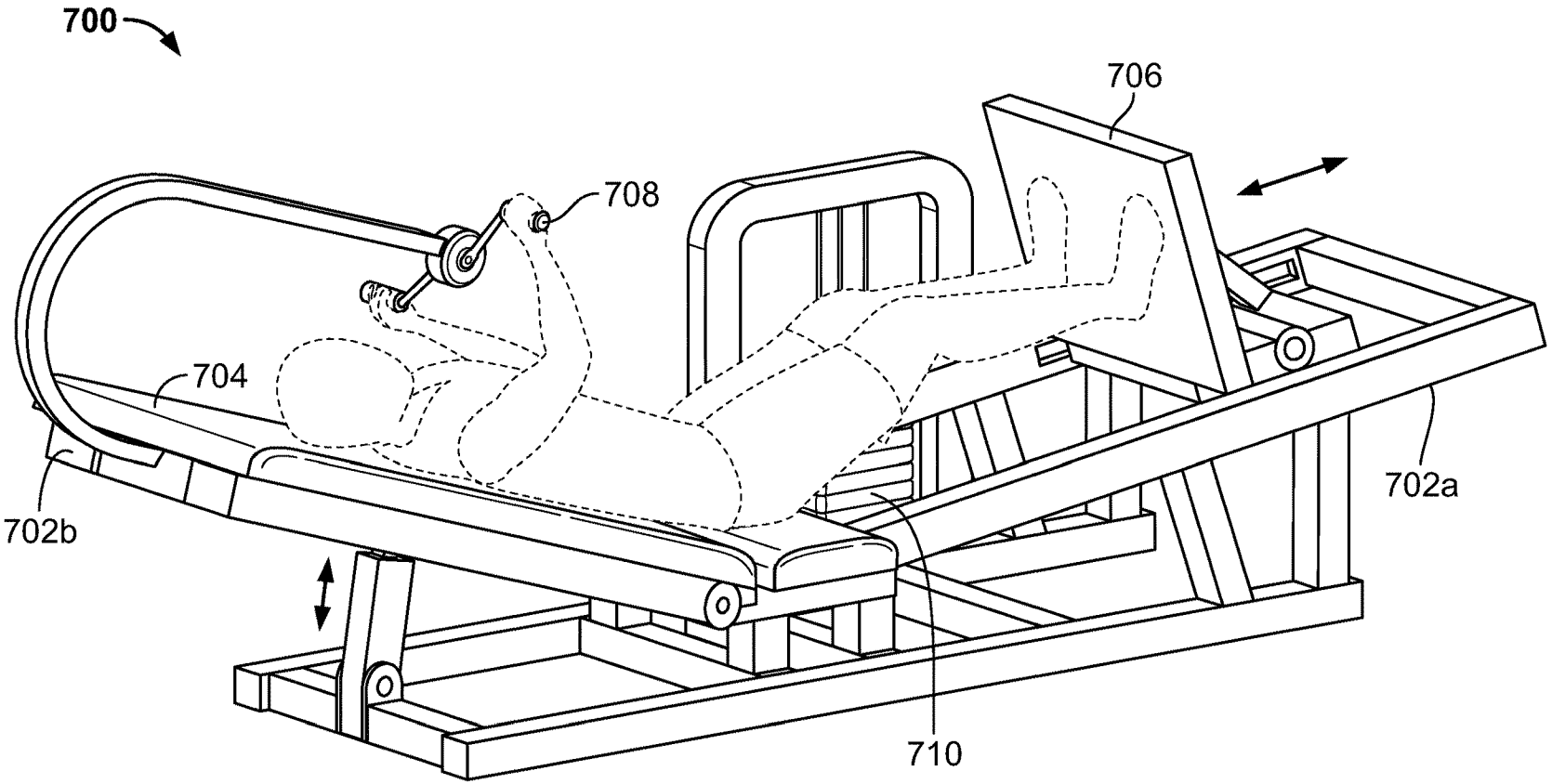
FIG. 7B is a perspective view of the physical exercise apparatus shown in FIG. 7A, with a user disposed thereon.

Referring to FIG. 7B, a method of physical exercise training may comprise providing physical exercise apparatus 700 and positioning at least a portion of a body of a user in an at least partially supine position on the seat 704. The user may access the movable sled 706 from the at least partially supine position by placing a portion of his or her lower body, for example, his or her feet, on the movable sled 706. The user may also grasp the cycling hand pedals 708 with his or her hands from the at least partially supine position.

Figure 7C:
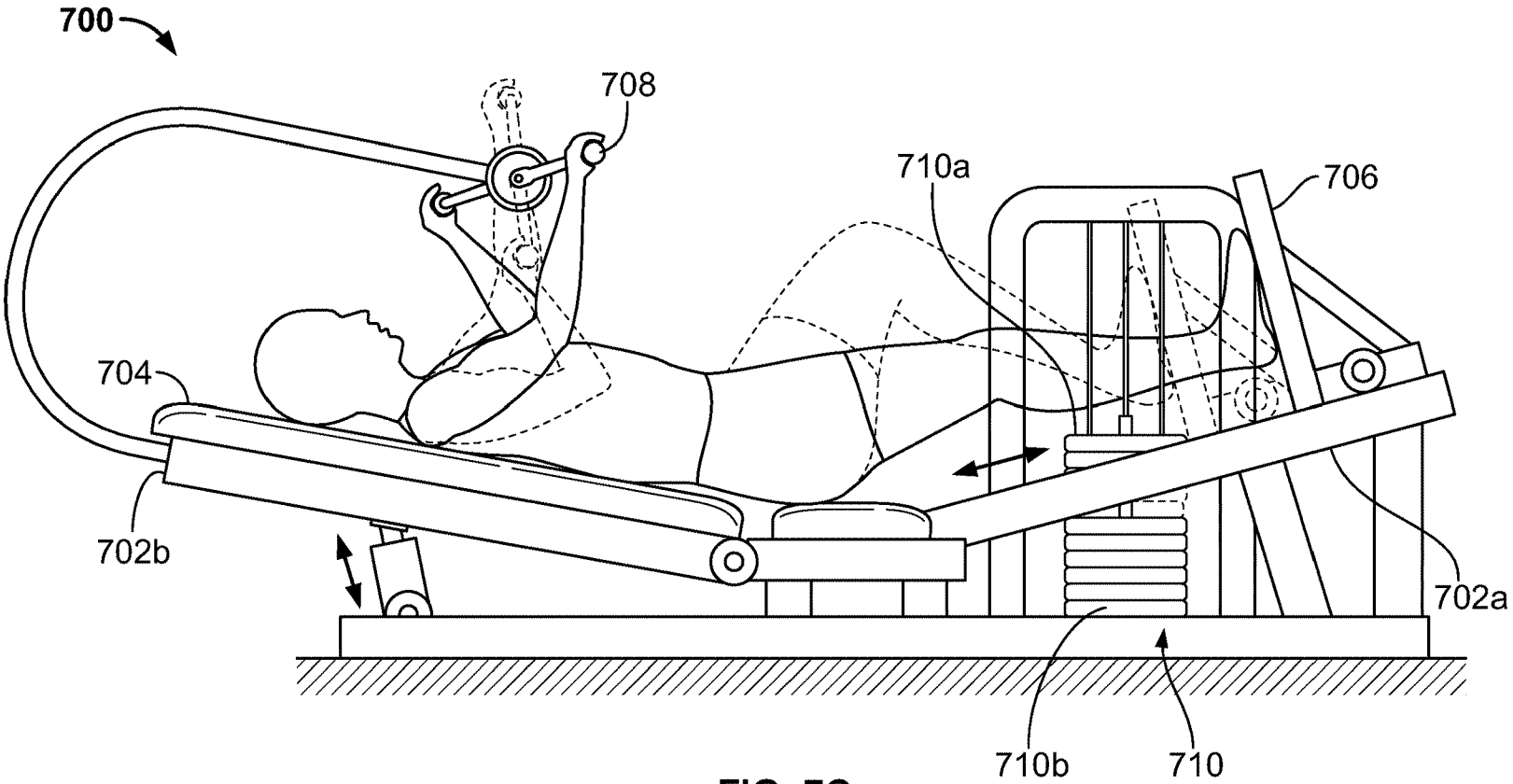
FIG. 7C is a side view of the physical exercise apparatus shown in FIG. 7A being operated by a user.

With reference to FIG. 7C, the user may simultaneously move the movable sled 706 generally upwardly and away from the seat 704 by driving his or her feet into the movable sled 706 move the movable sled 706 along frame 702 while independently cycling the cycling hand pedals 708 from the at least partially supine position. In embodiments, the user may continuously cycle the pair of cycling hand pedals 708 during movement of the movable sled 706. Such movement of the movable sled 706 by the user may cause a selected portion 710*a* of the resistance load 710 to linearly move along a portion of the frame 702. An unselected portion 710*b* of the resistance load 710 may remain stationary along the frame 702. In embodiments, a selected portion 710*a* of the resistance load 710 may comprise the entire resistance load 710.

The cycling motion of the user's upper body may provide distraction so that the user is positioned in a manner to perform leg presses with the movable arm 706 so that a substantially even resistive loading is received by, for example, the user's gluteus and/or quadriceps muscles. In this manner, a resistive loading may be transferred to the user's gluteus and/or quadriceps muscles that is symmetric about an axial midline of the user's body. Such a resistive loading may minimize, prevent and/or improve muscular imbalances, and may encourage and/or maintain symmetrical development of muscles with respect to an axial midline of the body within target muscle groups.

In embodiments, the distraction of the upper body caused by the cycling motion of a user's upper body may substantially biomechanically isolate muscles of the upper body so that increased loading is experienced by target muscle groups. In such embodiments, target muscle groups may include the gluteus and/or quadriceps muscles. In this manner, a user may be inhibited from twisting, jerking, and/or shifting when using the physical exercise apparatus 700 using muscles of the lower body of the user to leverage muscles of the upper body in performing leg presses with the movable sled 706.

It will be understood that the presently-disclosed physical exercise apparatuses may be varied to suit the particular needs of user. In embodiments, components of a physical exercise apparatus, such as a seat, a base, one or more movable arms, a movable sled, and/or a pair of cycling hand pedals, to name a few, may be monolithically formed with or separable from a frame in a manner similar to or different from physical exercise apparatus 100 described above. In embodiments, a frame may be an integrally formed member or may be formed of one or more frame components. In embodiments, a physical exercise equipment apparatus may include, for example, linear and/or curvate frame portions, one, a pair, or more than two movable arms, and/or variable seat configurations, to name a few. In embodiments, a movable arm may comprise a substantially rigid member. In embodiments, a frame may be attached to a surface or otherwise be configured to have a generally stationary configuration. In embodiments, a frame may include one or more members to provide mobility to the frame, such as a wheel or sliding surface pad.

In the exemplary embodiments of the present disclosure, a seat may be one of a bench, chair, or stool, to name a few, and combinations thereof. In embodiments, a seat may include a back support and a lower body support. In embodiments, a back support may be disposed at an angle with respect to the lower body support, for example, an angle of about 40 degrees with respect to a reference line drawn through the lower body support. In embodiments, a back support may be disposed at a fixed angle with respect to a lower body support. In embodiments, a back support may be adjustable, such movably coupled, with respect to a lower body support such that the back support may be moved through a range of angles with respect to the lower body support. In embodiments, a back support may be disposed at a fixed or adjustable angle of, for example, between and including about 180 degrees and about 90 degrees with respect to a seat support.

In the exemplary embodiments of the present disclosure, one or more hand pedals may have any desirable configuration, for example, flat, grooved, ergonomically-shaped and/or incorporating a user retention member such as a strap, clip, or stirrup, to name a few.

While this invention has been described in conjunction with the embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A physical exercise apparatus, comprising:

a frame;

a base supported by the frame and configured to support a user in an at least partially upright position, wherein the at least partially upright position includes a user fully standing, leaning, and/or standing with an at least partial bend at the user's waist and/or knees;

a sled movably attached to a first portion of the frame and coupled with a linearly movable resistance load and configured for the user to face forward such that the user's back is positioned against the sled for the user to perform a target exercise of raising and lowering the sled that uses the linearly coupled movable resistance load and that is targeted to developing at least one of the gluteus or quadriceps muscles of the user while the user is in the at least partially upright position; and a pair of cycling hand pedals attached to a second portion of the frame and independently movable from the sled so that the user can cycle the pair of cycling hand pedals with the user's hands as a distraction exercise, while the user is simultaneously performing the target exercise by separately moving the sled with a portion of his or her upper body in the at least partially upright position, to distract the user during the target exercise and substantially biomechanically isolate muscles of the user's upper body to target the exercise of the at least one of the gluteus or quadriceps muscles.

2. The physical exercise apparatus of claim 1, wherein the sled is movably attached to the first portion of the frame so that the sled may be moved generally upwardly with respect to the base.

3. The physical exercise apparatus of claim 1, wherein the sled is configured for a user to perform a hack squat with the user's body.

4. The physical exercise apparatus of claim 1, wherein the linearly movable resistance load is a weight stack.

5. The physical exercise apparatus of claim 1, wherein the apparatus is configured to achieve a substantially even resistive loading of muscles that is symmetric about the axial midline of the user's body.

6. The physical exercise apparatus of claim 1, wherein the movability of the sled independently of the pair of cycling hand pedals is such that the hand pedals are movable in a cycling direction independently of the movable sled but the movable sled and the pair of cycling hand pedals are coupled together so as to be raised and lowered together when raising and lowering the movable sled so that the cycling is performable simultaneously with a user's movement of the sled.

* * * * *